US005419657A

United States Patent [19]

Davis

[11] Patent Number: 5,419,657

[45] Date of Patent: May 30, 1995

[54] METHOD AND APPARATUS FOR TRANSFERRING A STRUCTURE FROM A JACK-UP RIG TO A FIXED PLATFORM

[75] Inventor: James B. Davis, Houston, Tex.

[73] Assignee: Rowan Companies, Inc., Houston, Tex.

[21] Appl. No.: 155,094

[22] Filed: Nov. 18, 1993

Related U.S. Application Data

[63] Continuation of Ser. No. 880,717, May 8, 1992, abandoned.

[51] Int. Cl.[6] ..... E02B 17/04

[52] U.S. Cl. ..... 405/209; 52/726.1; 403/13; 403/340; 403/364; 405/195.1; 405/196

[58] Field of Search ..... 405/201, 209, 196, 203; 52/726.1, 726.2; 403/13, 364, 340

[56] References Cited

U.S. PATENT DOCUMENTS

| | | | |
|---|---|---|---|
| 859,811 | 7/1907 | Harrington . | |
| 1,272,131 | 7/1918 | Silberg . | |
| 1,773,068 | 8/1930 | Vienneau . | |
| 1,894,950 | 1/1933 | Fitch . | |
| 2,267,638 | 12/1941 | Clark . | |
| 2,475,046 | 7/1949 | Pederson . | |
| 2,489,869 | 11/1949 | Dunn . | |
| 2,644,971 | 7/1953 | Rowe . | |
| 2,934,905 | 5/1960 | Woolslayer et al. . | |
| 2,959,015 | 11/1960 | Beck . | |
| 2,997,852 | 8/1961 | Suderow . | |
| 3,011,318 | 12/1961 | Ashton . | |
| 3,033,525 | 5/1962 | Johnson . | |
| 3,150,787 | 9/1964 | Patrignani . | |
| 3,204,300 | 9/1965 | Hofmann . | |
| 3,253,842 | 5/1966 | Rabe | 403/364 X |
| 3,355,196 | 11/1967 | Harrison . | |
| 3,477,235 | 11/1969 | Branham et al. . | |
| 3,692,340 | 9/1972 | Roth | 52/726.1 X |
| 3,931,778 | 1/1976 | Miller et al. . | |
| 3,952,887 | 4/1976 | Lutz . | |
| 3,955,895 | 5/1976 | Raimbault . | |
| 4,055,264 | 10/1977 | Abbott . | |
| 4,103,503 | 8/1978 | Smith | 405/201 X |
| 4,435,104 | 3/1984 | Held | 403/364 X |
| 4,456,404 | 6/1984 | Evans | 405/209 X |
| 4,483,644 | 11/1984 | Johnson | 405/201 |
| 4,620,447 | 11/1986 | Kimball . | |
| 4,826,355 | 5/1989 | Marion | 405/209 |
| 4,938,628 | 7/1990 | Ingle . | |
| 4,973,198 | 11/1990 | Cox . | |
| 5,032,040 | 7/1991 | Ingle | 405/201 |
| 5,052,860 | 10/1991 | Ingle . | |

FOREIGN PATENT DOCUMENTS

| | | |
|---|---|---|
| 0204591 | 4/1986 | European Pat. Off. . |
| 0094434A1 | 11/1993 | European Pat. Off. . |
| 2405182 | 10/1977 | France . |
| 1462775 | 1/1977 | United Kingdom . |
| 2022521 | 12/1979 | United Kingdom . |

OTHER PUBLICATIONS

Shipbuilding and Shipping Record, vol. 119, No. 19, 1972, pp. 29–30, "A New Concept for Moving Heavy Loads".

Abstract of Japanese Patent No. 57–202654, Dated Sep. 14, 1984.

*Primary Examiner*—Dennis L. Taylor

*Attorney, Agent, or Firm*—Fish & Richardson

[57] ABSTRACT

A method and apparatus for transferring a functional package from a jack-up rig to a fixed platform is provided. A functional package comprising a drilling package, a construction crane, a rocket launch module, or other heavy apparatus may be directly placed upon a fixed platform without exceeding the load bearing limits of a fixed platform. This placement occurs using a cantilever beam that is spliced so that it may be separated into a shuttle portion and a base portion to reduce the weight effect of the cantilever beam upon the fixed platform. The cantilever beam may be provided with a new and unique splice section that permits detachment of the distal shuttle portion upon which rests a functional package. The distal shuttle may be deposited onto a fixed platform. The distal shuttle may be reattached after operations are completed for transfer of the functional package to another location.

20 Claims, 17 Drawing Sheets

METHOD AND APPARATUS FOR TRANSFERRING A STRUCTURE FROM A JACK-UP RIG TO A FIXED PLATFORM

This application is a file wrapper continuation of U.S. application Ser. No. 07/880,717, filed May 8, 1992, now abandoned.

FIELD OF THE INVENTION

This invention relates generally to a method and apparatus for transferring a modular structure functional package from a jack-up rig to a fixed platform, and, more particularly, to a method and apparatus for utilizing a conventional jack-up rig to transfer a drilling or construction package between a fixed off-shore platform for, say, construction, drilling or reworking of an existing well. Further, the invention relates to an apparatus and method for increasing the working range of a construction crane mounted upon a jack-up rig. Still further, the invention relates to an apparatus and method for testing or launching rockets and the like.

DESCRIPTION OF THE RELATED ART

It is common practice in the drilling of off-shore oil wells for a fixed platform to be constructed above a promising oil field so that a multiplicity of wells may be drilled at that location. Commonly, after the drilling process has been completed, the drilling portion of the platform is removed from the fixed platform and transported to another fixed platform where the same process is repeated. In this manner, the same drilling apparatus can be advantageously used on numerous fixed platforms. When the drilling apparatus is removed, the platform becomes merely a production platform, no longer having drilling capabilities, but remaining at the well site. Sometimes, it may be desirable to again place the drilling apparatus on the fixed production platform to drill additional wells into the field. Alternatively, it may be desirable to place a construction grade crane on a platform for construction or demolition of surrounding structures.

It is not uncommon that an increase in the price of oil or natural gas can cause a well that was not economically attractive to become attractive as a producing well. In these cases, the drilling apparatus may be replaced on the fixed platform so that additional wells may be drilled to increase the production of oil or gas from the field. Further, it is sometimes desirable that a derrick structure and support apparatus be placed on the fixed production platform so that the existing wells may be "reworked" to maintain or increase a desired level of production.

Another activity that may be undertaken is the construction and demolition of fixed platforms. The construction and demolition of platforms is a labor intensive activity, and it requires specially designed, high capacity construction cranes to lift the building materials necessary for fixed platforms. The specially designed, high capacity cranes are often required to lift loads ranging between 450 and 1,000 tons.

It is presently common for cranes of this capacity, hereafter referred to as "construction cranes", to be mounted upon sea-going barges. Individual barges are, therefore, dedicated as construction barges. However, those of ordinary skill in the art will appreciate that a barge-mounted crane will roll, pitch, amid yaw with the movement of the sea surface. This movement adversely affects the ability of a construction crane to safely and accurately lift large loads. In light of this fact, it may be desirable to transfer an in-board position generally inside the outer edge or perimeter of the deck of the construction crane from a jack-up rig to the stable deck of a fixed platform. In that way, a construction crane may be more conveniently and safely utilized on a fixed platform to lift large loads in the area immediately surrounding and including the platform.

Furthermore, a construction crane may be utilized to construct or disassemble fixed platforms, or to lift other heavy loads, by extending the crane to an outboard position using the cantilever beam, and then using the crane to lift loads in the immediate vicinity of the fixed platform. Furthermore, the cantilever beam similarly may be used to extend a construction crane beyond the deck of a jack-up rig for construction of bridges or other structures. Of independent significance, it is believed that vehicles such as rockets and the like could be conveniently launched from a stable jack-up rig. The platform provided by the cantilever beam when extended over the edge of the deck of the jack-up rig provides an especially desirable arrangement because the hot exhaust from the rocket engine(s) may be directed towards the sea with minimal environmental impact.

The immense size of movable drilling apparatus and construction cranes creates substantial technical difficulties in transporting such apparatus and accurately locating them onto fixed platforms at reasonable cost. Furthermore, locating a drilling package or a construction crane on a fixed platform is a time consuming process. Several prior art systems have been devised to transfer a drilling package to a fixed platform.

For instance, pending application Ser. No. 07/609,927, filed Nov. 6, 1990, describes a method and apparatus for transferring a drilling structure from a movable vessel to a fixed platform. That application describes a skid base locking apparatus for locking a skid base to a structure. The skid base contains a pair of skid rails mounted on an upper surface. In that procedure, the jack-up rig is positioned next to a platform, and a skid base is extended onto the fixed platform. At that point, the jack-up rig is elevated, and the drilling package is skidded onto the skid base of the fixed platform by sliding it onto the fixed platform using skid rails mounted on the upper surface of the skid base. This transfer of a drilling package using a skid-off procedure is believed to be an improvement over prior systems, but it is still a relatively time consuming process, taking many hours to perform.

Other prior art systems have been proposed for transporting a drilling apparatus from a jack-up platform to a fixed platform. For example, U.S. Pat. No. 4,103,503, issued Aug. 1, 1978 to Marvin L. Smith describes a method and apparatus that has utility in the oil well drilling community.

Smith describes a system for transporting the drilling apparatus from the jack-up platform to the fixed platform in two stages. Before the transfer process begins, the jack-up platform is first positioned adjacent the fixed platform, and then the drilling apparatus is transferred in two separate pieces, a skid base and a drilling structure. One of the shortcomings of the above prior art methods and apparatus for transferring a functional package, in particular a drilling package, is the length of time it takes to perform such operations.

Other prior art methods exist whereby a cantilever beam structure is transferred to a fixed platform with a drilling apparatus resting on the cantilever structure. Both the cantilever and the drilling package are placed upon the fixed platform. Further, the enormous weight of the cantilever and drilling structures is such that the load limits of the platform may be exceeded by the operation of the drilling package.

Platforms have load limits that cannot be exceeded without causing severe damage to the fixed platform. If a drilling package were mounted upon a cantilever beam and extended out over a fixed platform, and lowered to the fixed platform, then the weight of the entire cantilever beam and drilling package, when placed upon the fixed platform, would risk instability of most fixed platforms. Most fixed platforms cannot withstand the weight of a cantilever beam and a drilling package.

The industry is better served by a system that quickly and efficiently places a large functional package, such as a drilling package or a construction crane, upon a fixed platform in an appropriate manner, without exceeding the load limits of the fixed platform. What is needed in the industry is a method and apparatus that can accurately, quickly and easily place a drilling package upon a fixed platform without the time consuming and difficult practice of skidding, sliding, or depositing the entire weight of the cantilever and the drilling apparatus onto the fixed platform.

It has long been desired to quickly and easily place a drilling package upon a fixed platform by cantilevering the drilling package onto the fixed platform. However, prior to the present invention, no one has been able to provide a solution to the problem of excess weight placed upon the fixed platform. The present invention solves the problem of excess weight being placed upon the fixed platform, and it facilitates the placement of a drilling package or other large structure directly upon a fixed platform without a relatively time consuming skid-off procedure.

Further, the launching of rockets poses a set of problems relating to noise, heat and safety. Rockets for the placement of, say, communications satellites into geosynchronous orbit require locations on land occupying very significant acreage to suitably isolate the launch site to minimize the hazards from noise and heat. To assure the safety of neighboring persons and the security of the launch site from intrusion, fences, walls, and other structures are required.

It has long been desired to have a launch site secure from intrusion and environmentally benign. The present invention solves these problems by providing a method and apparatus that facilitates the transporting of a rocket launch module by a jack-up rig to an offshore location where the rocket can be launched from a stable platform without the concerns that trouble shore based facilities.

SUMMARY OF THE INVENTION

In one aspect of the present invention, an apparatus for transferring a functional package or module from a jack-up rig to a fixed platform is provided. A cantilever beam is adapted for separation into a distal shuttle portion and a proximal base portion. The functional package is supported by the distal shuttle portion of the cantilever beam. The cantilever beam is adapted for transferring the functional package from an inboard position generally inside the perimeter of the deck of the jack-up rig to an outboard position over an edge of the jack-up rig. Furthermore, the jack-up rig is adapted for supporting and positioning the cantilever beam. The distal shuttle portion of the cantilever beam can be supported by the fixed platform after separation of the cantilever beam.

It is contemplated that the present invention could be used to transport modules of various types. For example, the apparatus and method may be used to transfer different types of heavy equipment packages from a jack-up rig to a fixed platform. The functional package transferred may be a drilling package, a construction crane or even a rocket launch module.

In another aspect of the invention, the cantilever beam contains a splice to effect separation of the cantilever beam into a distal shuttle portion and a proximal base portion. The splice may be comprised of a plurality of fingers adapted to selectively interlock or disengage.

In one application of the present invention, the splice also may be composed of a beam sandwich, in which a top beam plate, bottom beam plate and middle beam plate align in registration. The top beam plate and bottom beam plate may pivot upon one or more axes to coordinate and form a beam sandwich.

Yet another aspect of the present invention entails a method of transferring a functional package from a jack-up rig to a fixed platform including the step of separating a cantilever beam into a distal shuttle portion and a proximal base portion. In that method, a jack-up rig is first transported, with a module or functional package resting thereon, to a location of a fixed platform in an ocean or other body of water. Next, a jack-up rig is positioned adjacent to the fixed platform. The deck of the jack-up rig is raised to position the cantilever beam above the height of the deck of the fixed platform, and the distal end of a cantilever beam is extended from the deck of the jack-up rig. After the above extension, the jack-up rig is lowered so that the distal shuttle portion of the cantilever beam rests upon the fixed platform. Finally, the distal shuttle portion of the cantilever beam is separated from the proximal base portion to effect transfer of a drilling package or other functional package to the fixed platform. It will be appreciated that the transfer could also be made to a shore based deck or to another jack-up rig.

In another aspect of the present invention, the jack-up rig may be repositioned to another location for utilization at a remote site. Later, that same jack-up rig, or another similar jack-up rig, may return to the location of the fixed platform for repositioning adjacent the fixed platform. In this aspect of the invention, the deck of the jack-up rig may be raised to position the proximal base portion adjacent to the distal shuttle portion. After that occurs, the proximal base portion may be reconnected to the distal shuttle portion to form again the cantilever beam. After that step, the distal shuttle end of the cantilever beam that has been reconnected may be retracted from the deck of the fixed platform, from a position outboard the jack-up rig to a position inboard the jack-up rig. Following retraction, the deck of the jack-up rig may be lowered, and the drilling package or other functional package of heavy equipment may be deployed elsewhere.

In yet another aspect of the present invention, a functional package may be transferred to a fixed platform in an instance in which the fixed platform contains a blowout preventer extending above the level of the deck of the fixed platform. In this aspect of the invention, the distal shuttle end of the cantilever beam, containing a plurality of removable truss members, may be extended over the deck of the fixed platform. The distal end of the cantilever beam may proceed over one or more blow-out preventers or other obstructions by using a method of detaching and reattaching removable truss members, thereby preserving the structural integrity of the cantilever beam during transfer of the functional package.

In yet another aspect of the present invention, a functional package may comprise a rocket. The fixed platform may serve as a launch pad for the rocket. In another aspect of the invention, the functional package may comprise an engine to be tested.

BRIEF DESCRIPTION OF THE DRAWINGS

Other objects and advantages of the invention will become apparent upon reading the following detailed description and upon reference to the drawings in which.

Figure 1:
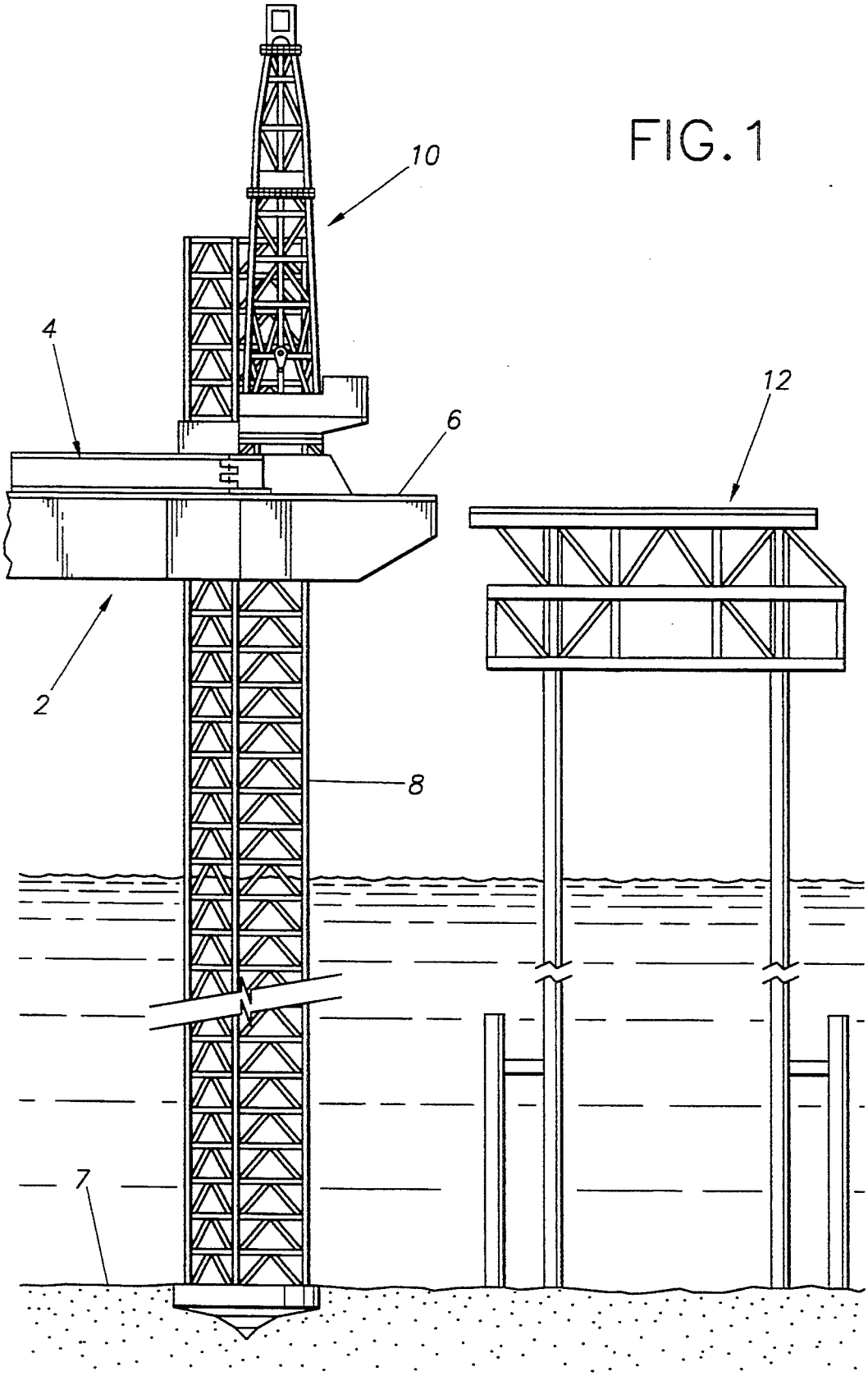
FIG. 1 illustrates a jack-up rig 2 containing a drilling package 10 resting thereon, adjacent a fixed platform 12.

While the system and apparatus is susceptible to various modifications and alternative forms, a specific embodiment thereof has been shown by way of example in the drawings and will herein be described in detail. It should be understood, however, that this specification is not intended to limit the invention to the particular form disclosed herein, but on the contrary, the intention is to cover all modifications, equivalents, and alternatives falling within the spirit and scope of the invention, as defined by the appended claims.

DESCRIPTION OF THE PREFERRED EMBODIMENT

Referring to the drawings, and in particular FIGS. 1–9, the apparatus for transferring a module or functional package frown a jack-up rig 2 to a fixed platform 12 comprises several features. The method is illustrated in sequence in FIGS. 1–5. Preferably, a functional package such as a drilling package 10 rests upon the cantilever beam 4 on the jack-up rig 2. In FIG. 1, it can be seen that the jack-up rig 2 has transported a drilling package 10 from a remote location to a position adjacent a fixed platform 12. The jack-up rig 2 is supported on the sea bed 7, and has been raised to a height slightly higher than the fixed platform 12.

FIG. 1 illustrates the jack-up rig 2 positioned immediately adjacent the fixed platform 12 with sufficient horizontal spacing therebetween to allow the deck 6 to clear the fixed platform 12 as it is raised to its desired vertical height. A leg member 8 is shown lowered to a position where the sea floor is engaged. While only a single leg member 8 is illustrated in the drawings, it will be readily understood by those skilled in the art that at least three leg members 8 are present to provide stability to the jack-up rig 2.

Figure 2:
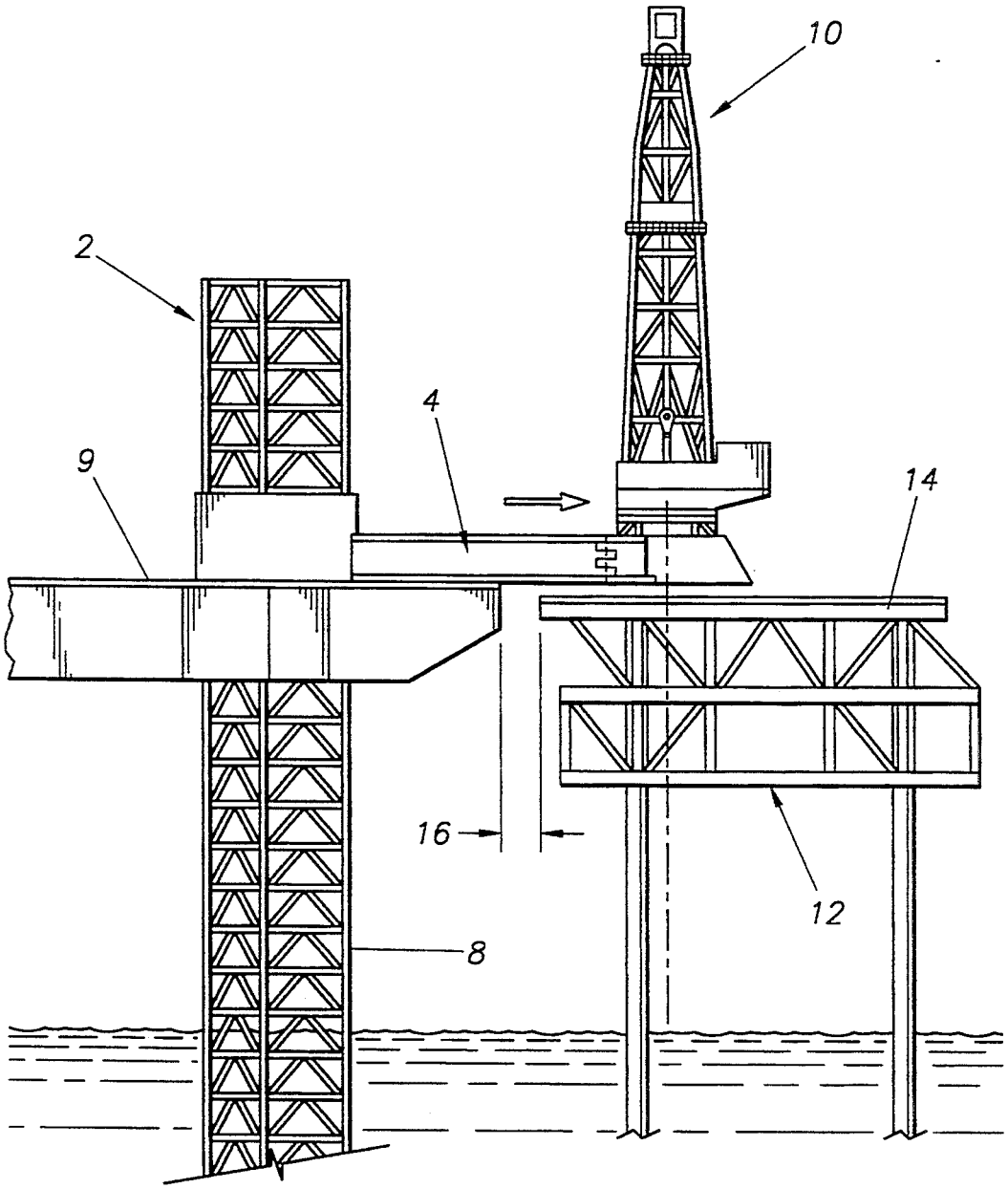
FIG. 2 illustrates the horizontal transfer of a drilling package 10, using a cantilever beam 4, from an inboard position on a jack-up rig 2 to an outboard position slightly above a fixed platform 12.
Figure 3:
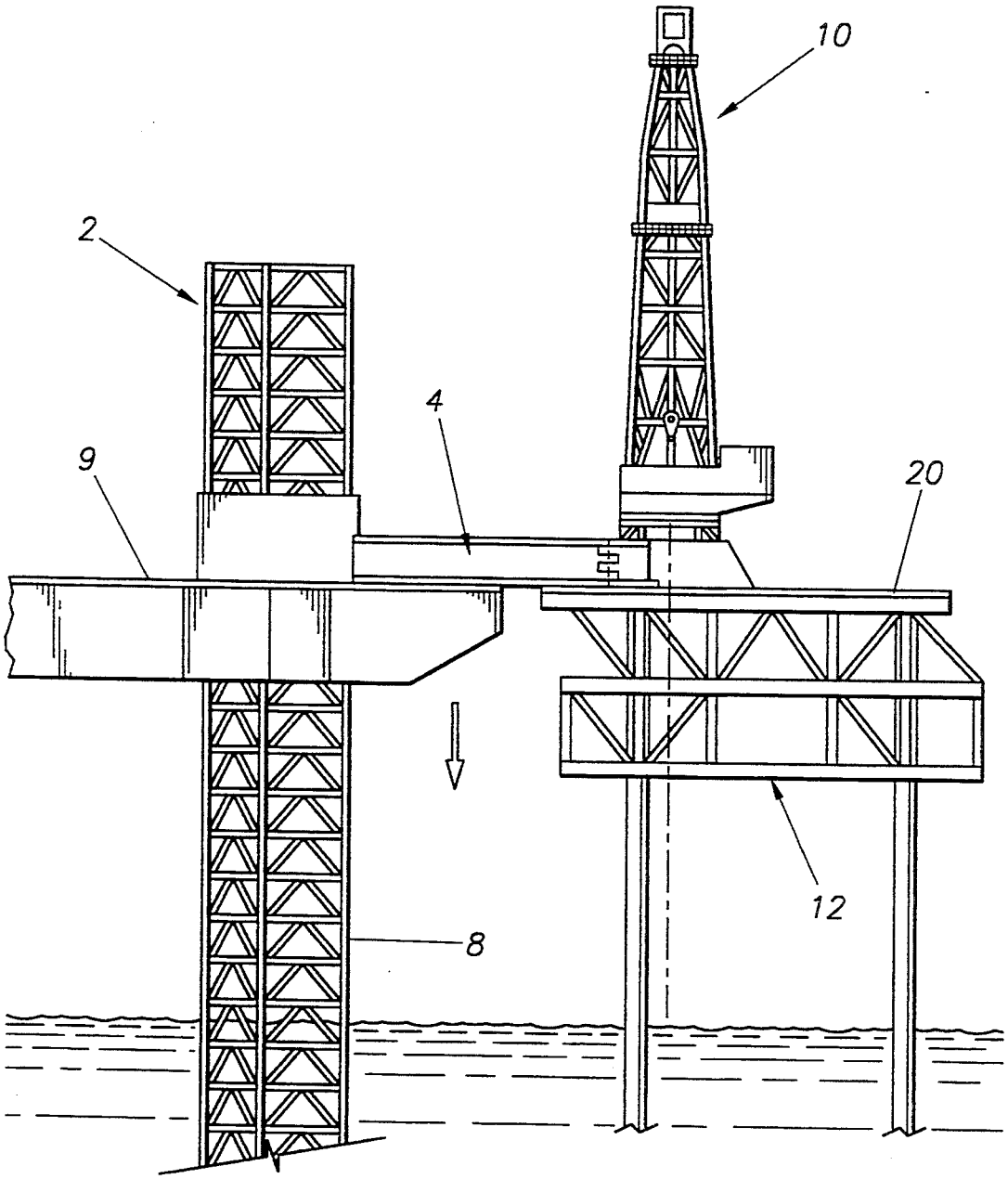
FIG. 3 illustrates a drilling package 10 being lowered to the surface of a fixed platform 12.

FIG. 2 and FIG. 3 illustrate the jack-up rig 2 in the process of transferring the drilling package 10 from the deck 6 of the jack-up rig 2 using the cantilever beam 4. The clearance distance 16 between the fixed platform 12 and the jack-up rig 2 is in the range from about 5 feet to 25 feet, preferably about 12 feet. To accomplish the transfer of the drilling package 10 to the fixed platform 12, hydraulic jacks 80 (FIG. 15) may be attached to the distal end of the cantilever beam 4, and fixed on the distal side 14 of the fixed platform 12. The hydraulic jacks 80 may be activated to pull the drilling package 10 and cantilever beam 4 onto the fixed platform 12.

FIG. 3 illustrates the jack-up rig 2 being lowered to a position such that the cantilever beam 4 rests upon the upper surface of the fixed platform 12. It preferably rests upon capping beams 20 of the fixed platform 12.

Figure 4:
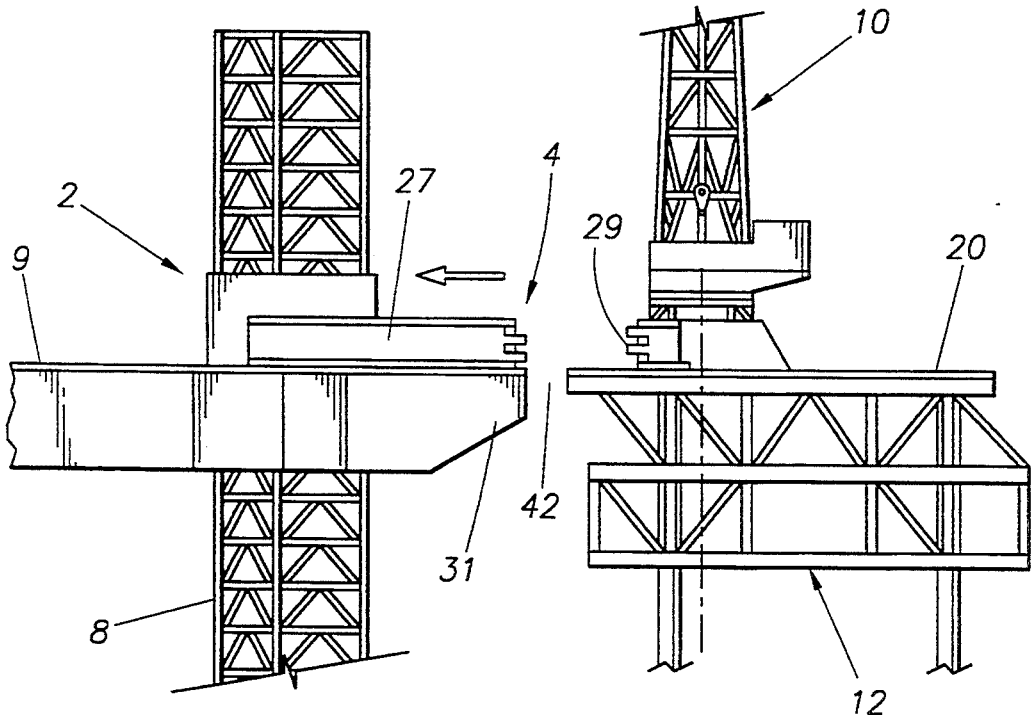
FIG. 4 illustrates the drilling package 10 after the cantilever beam 4 has separated.

Turning now to FIG. 4, the distal shuttle portion 29 is seen resting upon the fixed platform 12. The combined weight of the distal shuttle portion 29 and the drilling package 10 does not impose any excessive load on the fixed platform 12. To accomplish this result, as the distal end of the cantilever beam 4 is lowered upon the capping beams 20, the drilling package 10 comes to a full stop once the distal shuttle portion 29 of the cantilever beam 4 reaches a point slightly above the capping beams 20, preferably less than 1 foot above the beams, and most preferably, approximately 2 feet above the capping beams 20.

At this time, distance measurements may be taken over the area of the impending contact between the distal shuttle portion 29 of the cantilever beam 4 and the capping beams 20 of the fixed platform 12. The measurements should be approximately the same or slightly greater at the point that is most distant from the jack-up rig 2.

The distal shuttle portion 29 of the cantilever beam 4 is then lowered slowly by "popping" individual legs of the jack-up rig 2. This is done one leg at a time with careful inspection of the gap between the capping beams 20 and the distal shuttle portion 29 of the cantilever beam 4. The "popping" of legs of a jack-up rig 2 is a method of lowering the jack-up rig 2 in small increments.

When contact is made at any point, further lowering is halted. Load cells are then positioned on the four corners of the distal shuttle portion 29 of the cantilever beam 4 to monitor the final stages of transfer. Such load cells are common in this type of application, and recognized by a person skilled in the art.

Once all points of the distal shuttle portion 29 of the cantilever beam 4 are in contact with the platform capping beams 20, separation procedures may commence. Bolts are removed from the splice 42 as required to effect separation of the distal shuttle portion 29 of the cantilever beam 4 from the proximal base portion 27 of the cantilever beam 4.

FIG. 4 illustrates the apparatus after separation, and where the proximal base portion 27 has been retracted back onto the deck 6 of the jack-up rig 2. The distal shuttle portion 29 of the cantilever beam 4 now supports the drilling package 10 upon the fixed platform 12. It can be seen in FIGS. 1–4 that the drilling package 10 or other functional package has been moved from an inboard position generally inside the perimeter of the deck 6 of the jack-up rig 2 to an outboard position over the fixed platform 12, and then lowered upon the deck of the fixed platform 12. The functional package is supportable on the fixed platform 12 by the distal shuttle portion 29 of the cantilever beam 4.

Figure 5:
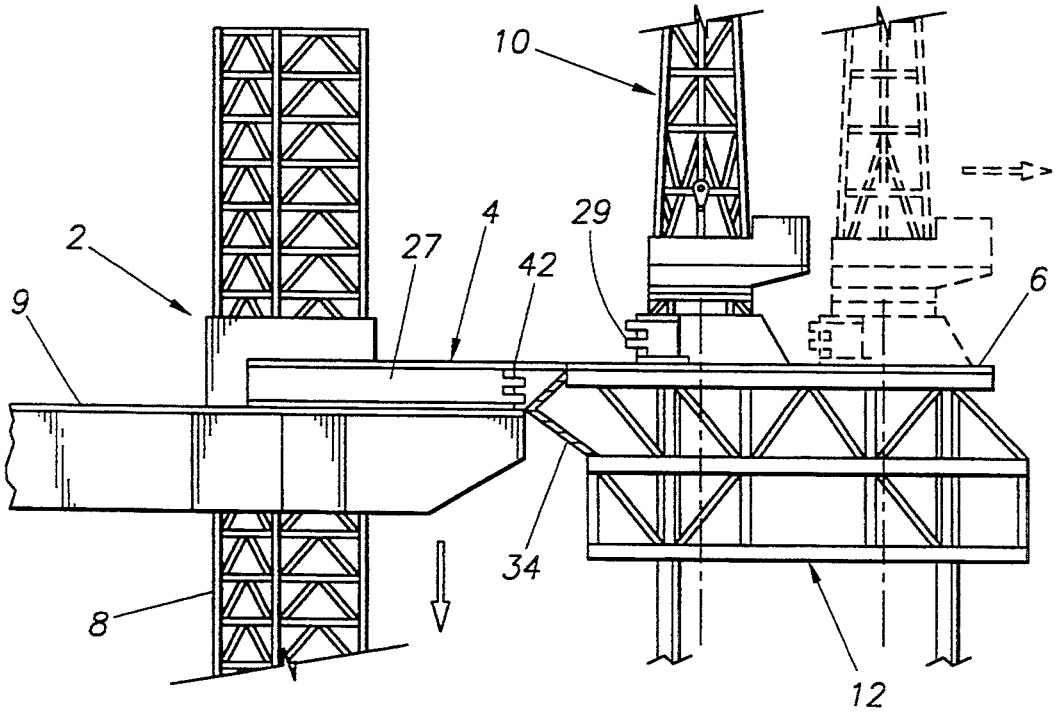
FIG. 5 illustrates the jack-up rig 2 in its lowered position such that the top of the base portion of the separated cantilever beam 4 is at about the same vertical height as the deck 6 of the fixed platform 12 to facilitate transfer of drilling pipe.

FIG. 5 illustrates the movement of the drilling package 10 to a desired position for drilling or reworking operations. This movement may be accomplished with hydraulic jacks 80 (see FIG. 15).

Figure 6:
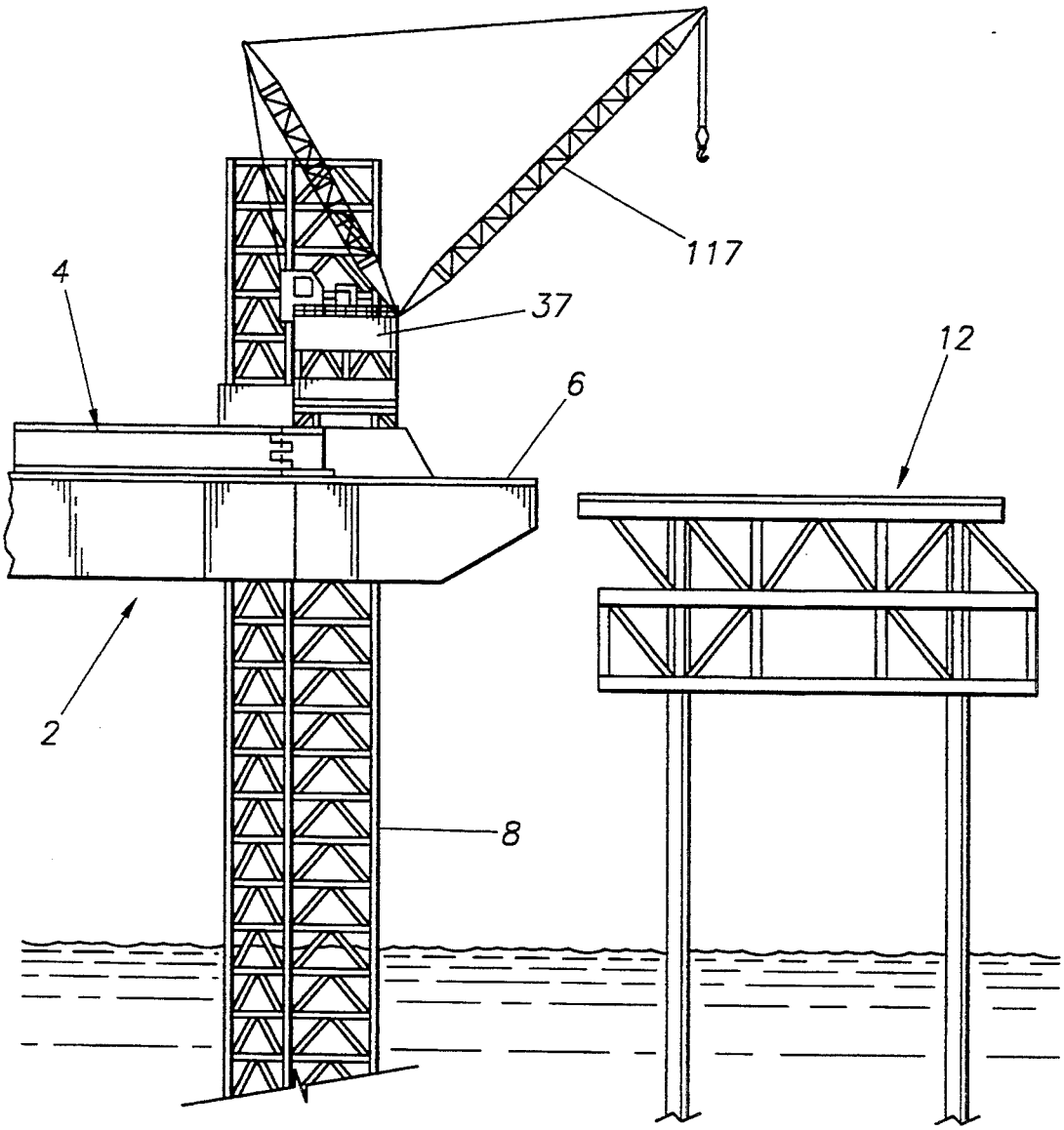
FIG. 6 illustrates an alternative embodiment of the method of the present invention in which the functional package is a construction crane 37 to be transferred to the fixed platform 12.
Figure 18:
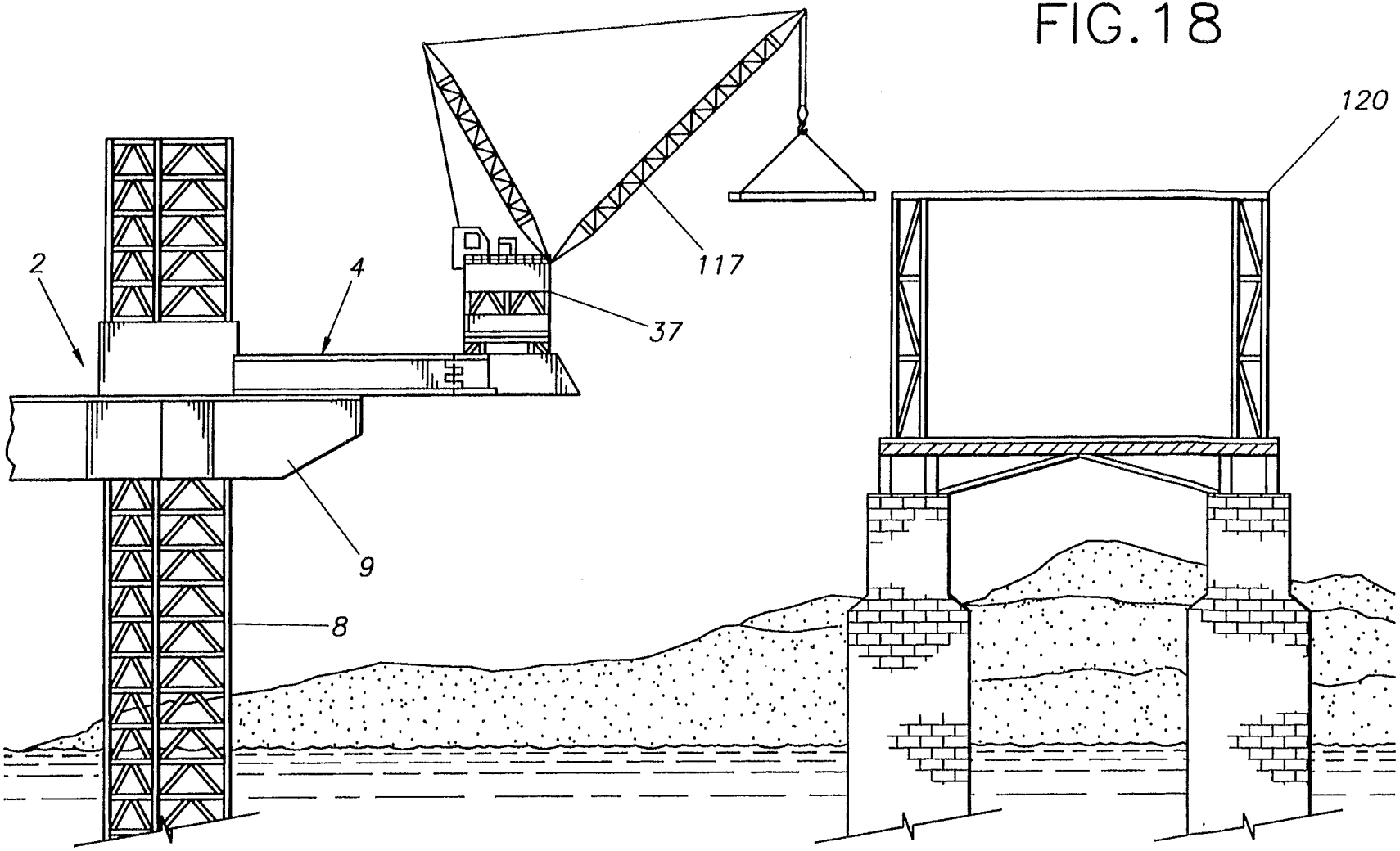
FIG. 18 illustrates an alternative embodiment of the present invention in which the functional package is a construction crane 37 to be extended to an outboard operating position.

FIG. 6 illustrates an alternative embodiment of the method of the present invention using a construction crane 37 as the functional package rather than a drilling package 10. It is recognized by a person skilled in the art that a construction crane 37 may be applied to many useful purposes upon a fixed platform 12. Furthermore, as seen in FIG. 18, a construction crane 37 alternatively may be used to lift heavy loads in an outboard position extending from the deck of the jack-up rig 2 (see FIG. 18).

Figure 7:
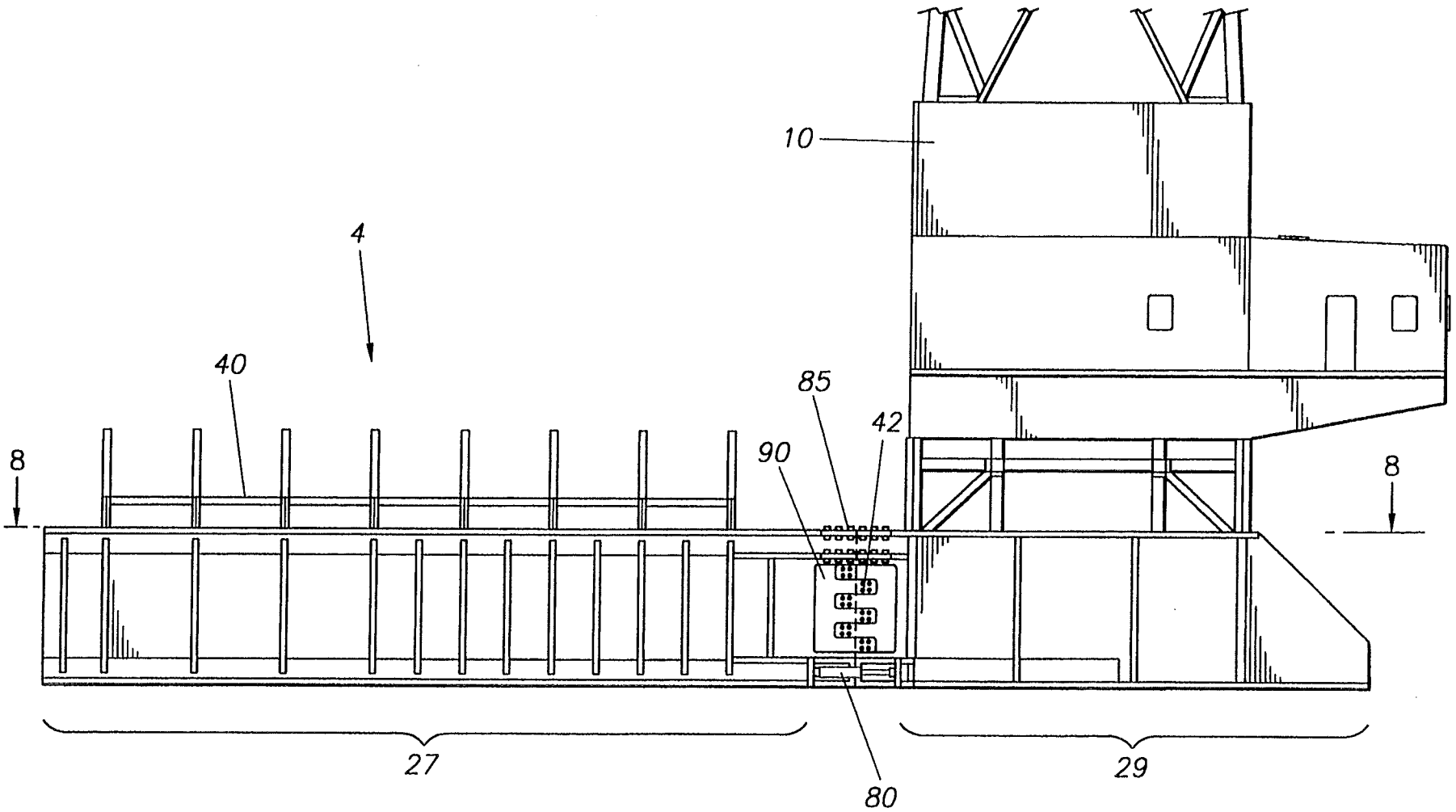
FIG. 7 illustrates a more detailed view of the splice 42 of the cantilever beam 4, showing the two portions of the cantilever beam 4, namely, the proximal base portion and the distal shuttle portion 29.

FIG. 7 illustrates a more detailed side view of the cantilever beam 4 with the drilling package 10 resting upon it. The splice 42 is seen as the separation point between the proximal base portion 27 and distal shuttle portion 29 of the cantilever beam 4. Furthermore, FIG. 7 depicts the presence of pipe racks 40 upon the proximal base portion 27 of the cantilever beam 4. The pipe rack 40 may be lowered to the surface of the proximal base portion 27 after transfer of the drilling package 10 to the fixed platform 12. It may be lowered at approximately 1.5 feet per minute.

Figure 8:
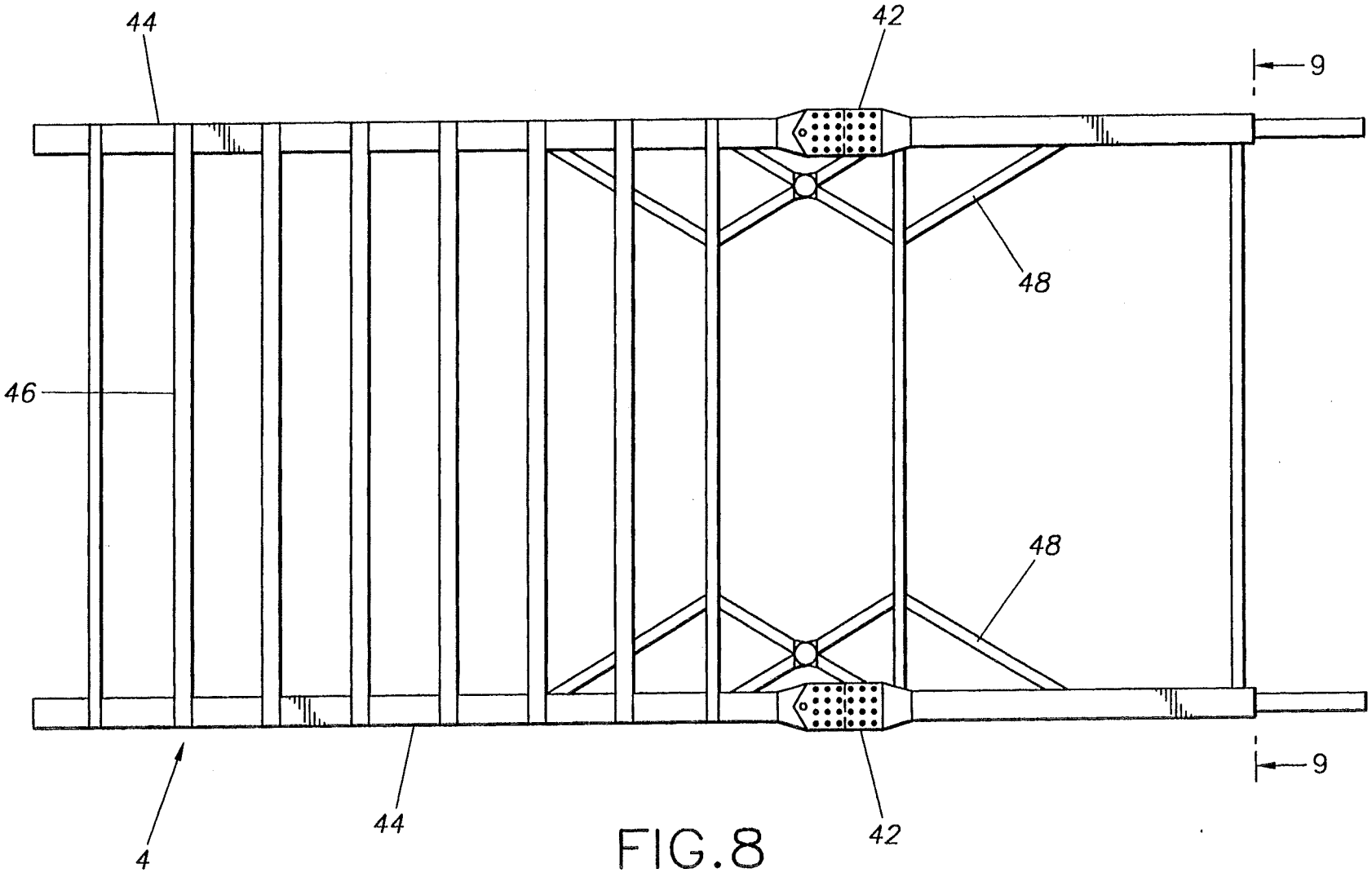
FIG. 8 illustrates a top view of the cantilever beam 4 and shows the connection of longitudinal brace members adjacent the splice 42.

FIG. 8 illustrates a top view of the cantilever beam 4. The cantilever beam 4 is comprised of two parallel cantilever struts 44 that are connected perpendicularly by cantilever cross-bars 46. Structural support to the splice 42 is supplemented by longitudinal brace members 48 that extend across the splice 42 of each strut 44, and are connected to several of the cantilever cross-bars 46.

Figure 9:
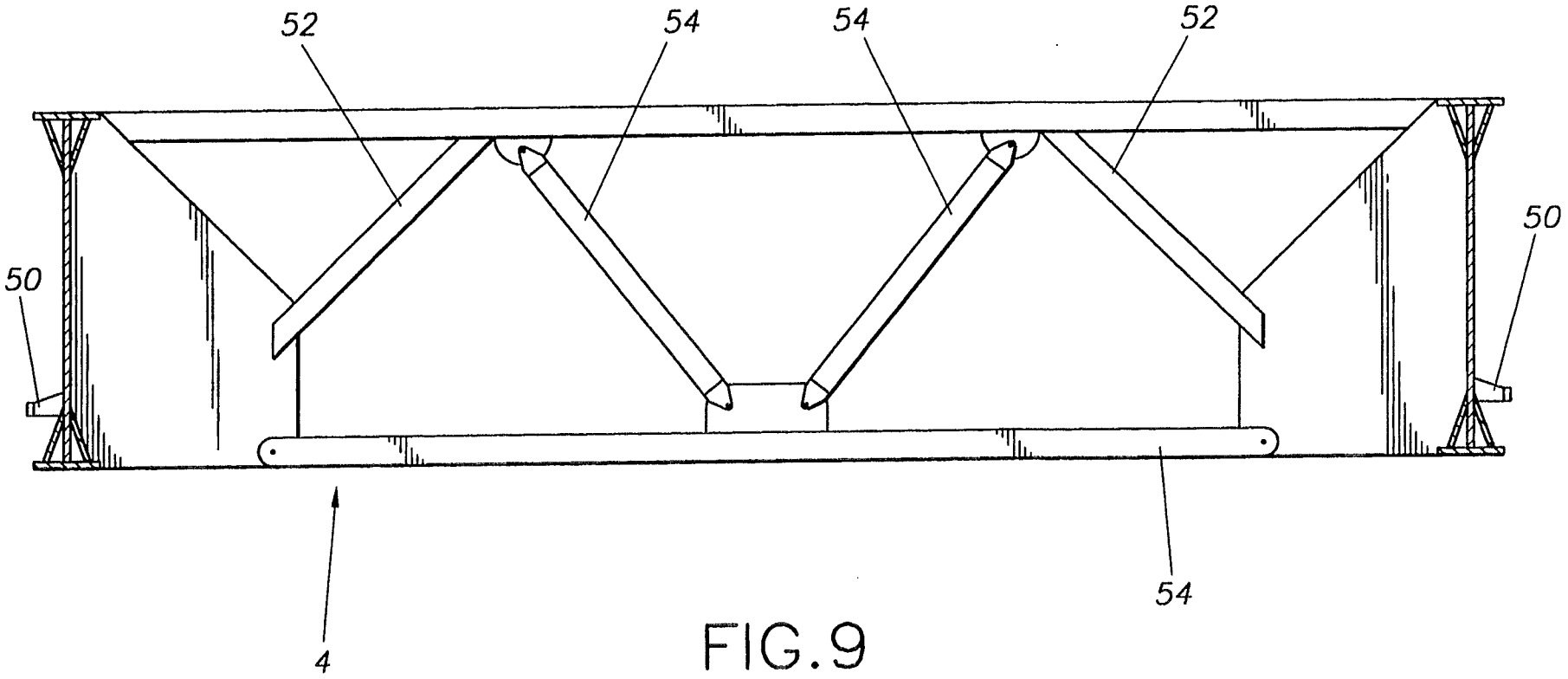
FIG. 9 illustrates an end view of the distal end of the cantilever beam 4 containing removable truss members 54.

FIG. 9 illustrates an end view of the cantilever beam 4 taken across section lines 9—9 of FIG. 8. FIG. 9 illustrates both fixed truss members 52 and the removable truss members 54. During transfer of the drilling package 10 to the fixed platform 12, removable truss members 54 may be removed and replaced as the distal end of the cantilever beam 4 passes over one or more blow-out preventers. The removable truss members 54 may be removed as a blow-out preventer is encountered, and then replaced once the blow-out preventer is past that particular point of the cantilever beam 4. In this way, the structural integrity of the cantilever beam 4 is preserved during transfer of the drilling package 10, without conflict with the blow-out preventers that may extend above the surface of the capping beams 20 of the fixed platform 12. FIG. 9 shows the skidder rack 50 that is used to transfer the cantilever beam 4 from the jack-up rig 2 to the fixed platform 12. The skidder rack 50 may be part of a rack-and-pinion assembly of a type known in this art to be suitable for pushing the cantilever beam 4 out over the fixed platform 12.

Thus, turning now to FIGS. 10–17, more details of the splice 42 are shown.

Figure 10A:
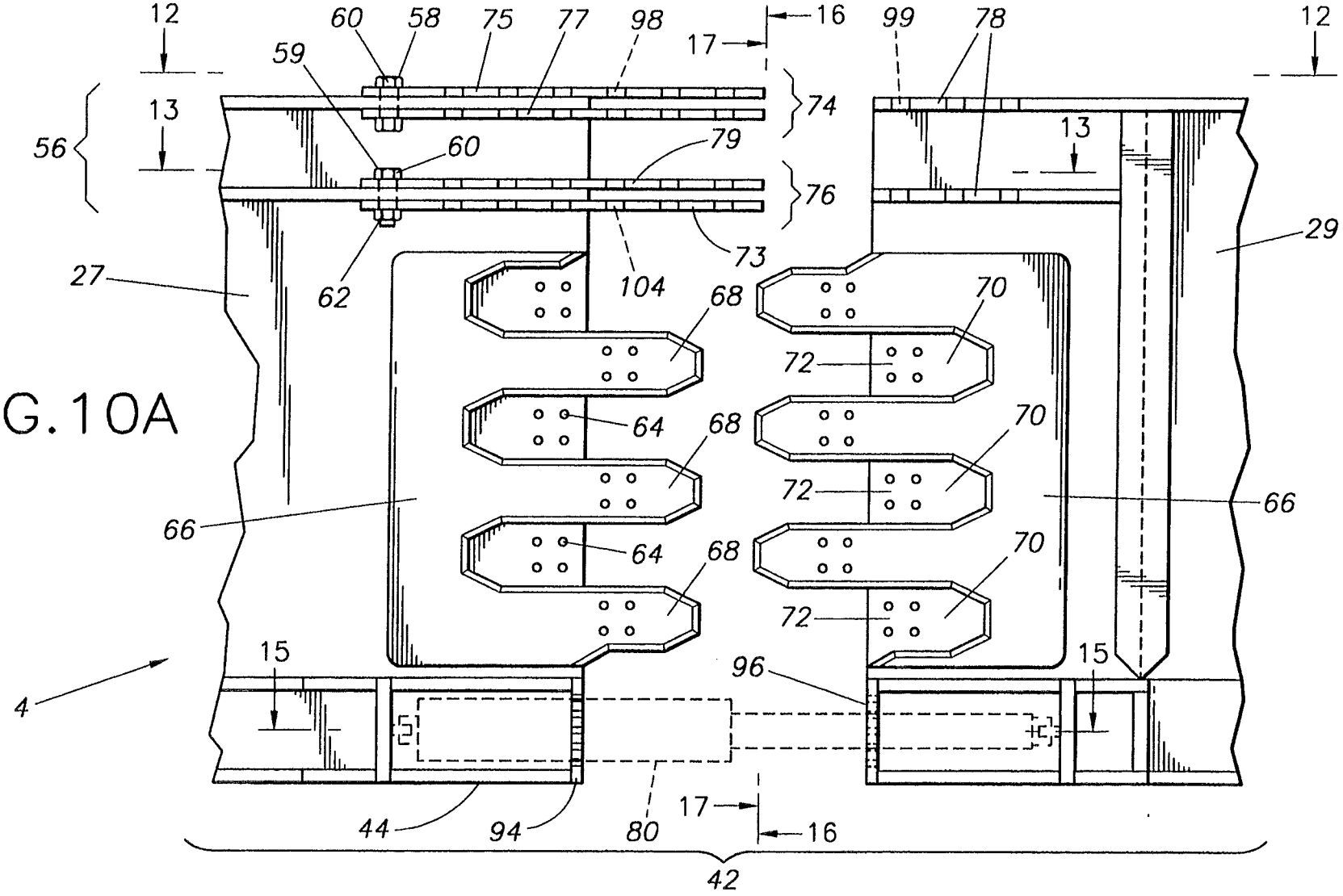
FIG. 10A illustrates in detail the splice 42 portion of the cantilever beam 4 in its open or separated position.
Figure 10B:
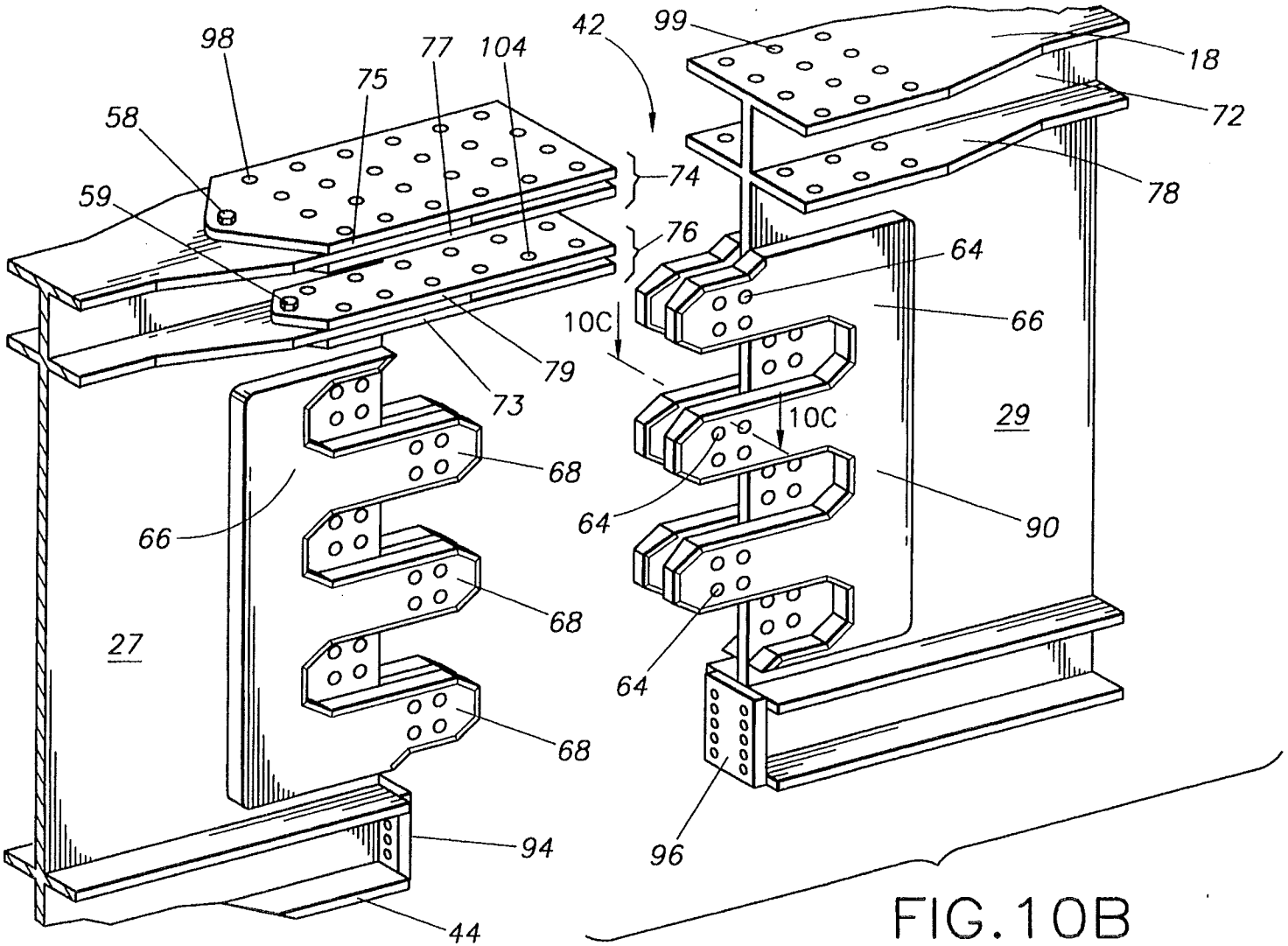
FIG. 10B illustrates a perspective view of the splice 42 of FIG. 10A.

FIG. 10A shows a more detailed side view of the splice 42 in its disengaged or unlocked position. Both the proximal base portion 27 and the distal shuttle portion 29 of the cantilever beam 4 contain fingers 68 that interlock together at the splice 42. A plurality of sets of fingers 68 is contemplated, and for illustrative purposes, six sets of fingers 68 are shown in FIG. 10B. As recognized by a person skilled in the art, the fingers 68 may comprise sets of fingers that extend together parallel from each side of the cantilever beam splice plate 66, or may comprise single fingers that alternate on either side of the splice plate 66, from top to bottom. Each finger 68 preferably interconnects into a recessed finger pocket 70. Furthermore, a web plate 72 contacts the innermost surface of each finger 68 during the time that the fingers 68 are interlocked. The fingers 68 are extensions of the cantilever beam splice plate 66. The recessed finger pockets 70 are defined by cut-away portions of the cantilever beam splice plate 66 and a surface of the web plate 72 (see FIG. 10B).

Figure 13:
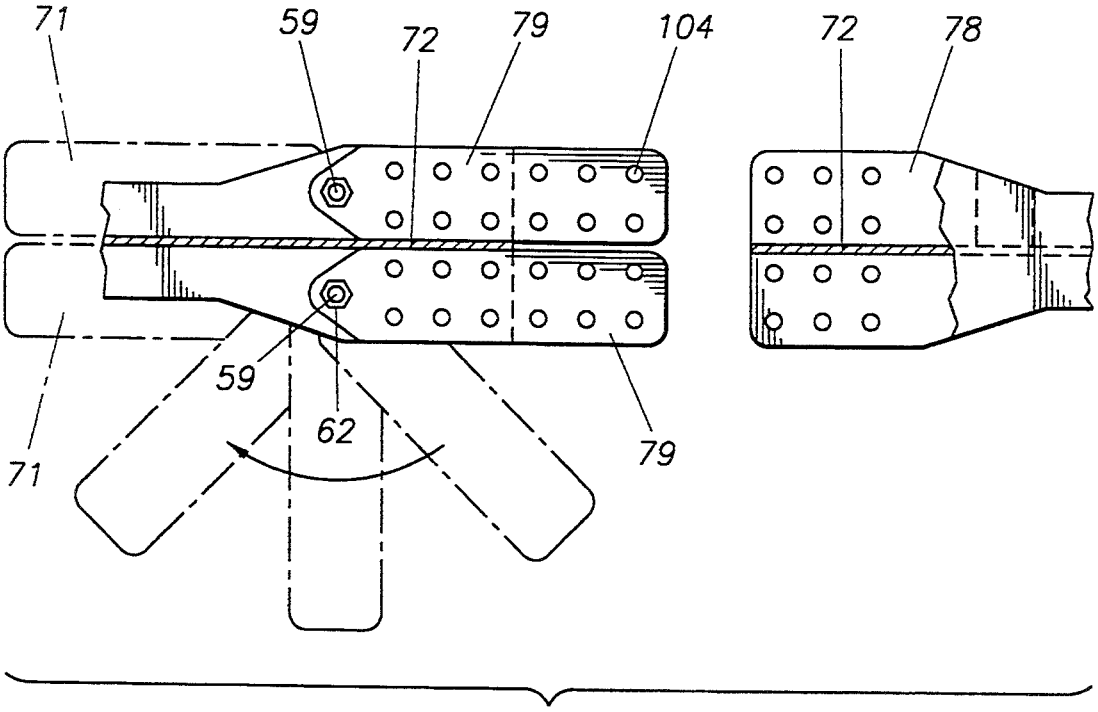
FIG. 13 illustrates a top view of the bottom beam plate 76 and middle beam plate 78 of the splice 42.

Furthermore, as may be seen in FIGS. 10A and 10B, beam sandwiches 56 comprise a top plate pivotal array 74 and a bottom plate pivotal array 76. The top plate pivotal array 74 is comprised of one full web top plate 75 and two half web back plates 77. The bottom plate pivotal array 76 is comprised of two half web top plates 79 and two half web back plates 73. The half web back plates and half web top plates of the bottom array each pivot outwardly from a closed sandwich position as seen in FIG. 13. They may be rotated 180° and stored in the storage position 71 (see FIG. 13) to protect the plates from damage during movement of the distal shuttle portion relative to the base portion. Furthermore, the plates are freely rotatable on their respective axes and they are stored in storage position 71 (see FIG. 13) after unlocking of the splice to prevent accidental rotation on their respective axes.

The top plate pivotal array 74 and bottom plate pivotal array 76 extend from the proximal base portion 27 of the cantilever beam. The two middle beam plates 78 extend from the distal shuttle portion 29 of the cantilever beam, and the top plate pivotal array 74, bottom plate pivotal array 76, and the two middle beam plates 78 coordinate together to form the two beam sandwiches 56. The top plate pivotal array 74 contains a plurality of top apertures 98 (see FIG. 12), the bottom plate pivotal array 76 contains a plurality of bottom apertures 104, and the middle beam plates 78 contain a plurality of middle apertures 99. (See FIGS. 12 and 13). The apertures are lined up in registration to permit the bolting of the plates into a sandwich structure using sandwich bolt 61 and sandwich nut 63 (see FIG. 11) to provide structural integrity to the cantilever strut 44.

With reference to FIG. 10B, upper pin 60 and lower pin 62 coordinate to permit the rotation of the top plate pivotal array 74 and bottom plate pivotal array 76. The top plate pivotal array 74 may be rotated in either direction to a point perpendicular to the splice 42. Each of the two half web back plates 73, the two half web top plates 79, and the two upper half web back plates 73 likewise may be rotated from their bolted position on their axes 180° around to a stored position.

The proximal inferior plate 94 is attached to the bottom of the base 27. A distal inferior plate 96 is attached to the bottom of the shuttle 29. The plates 94 and 96 have perforations that may be brought into registration and bolted to facilitate joining of the shuttle 29 to the base 27.

Figure 11:
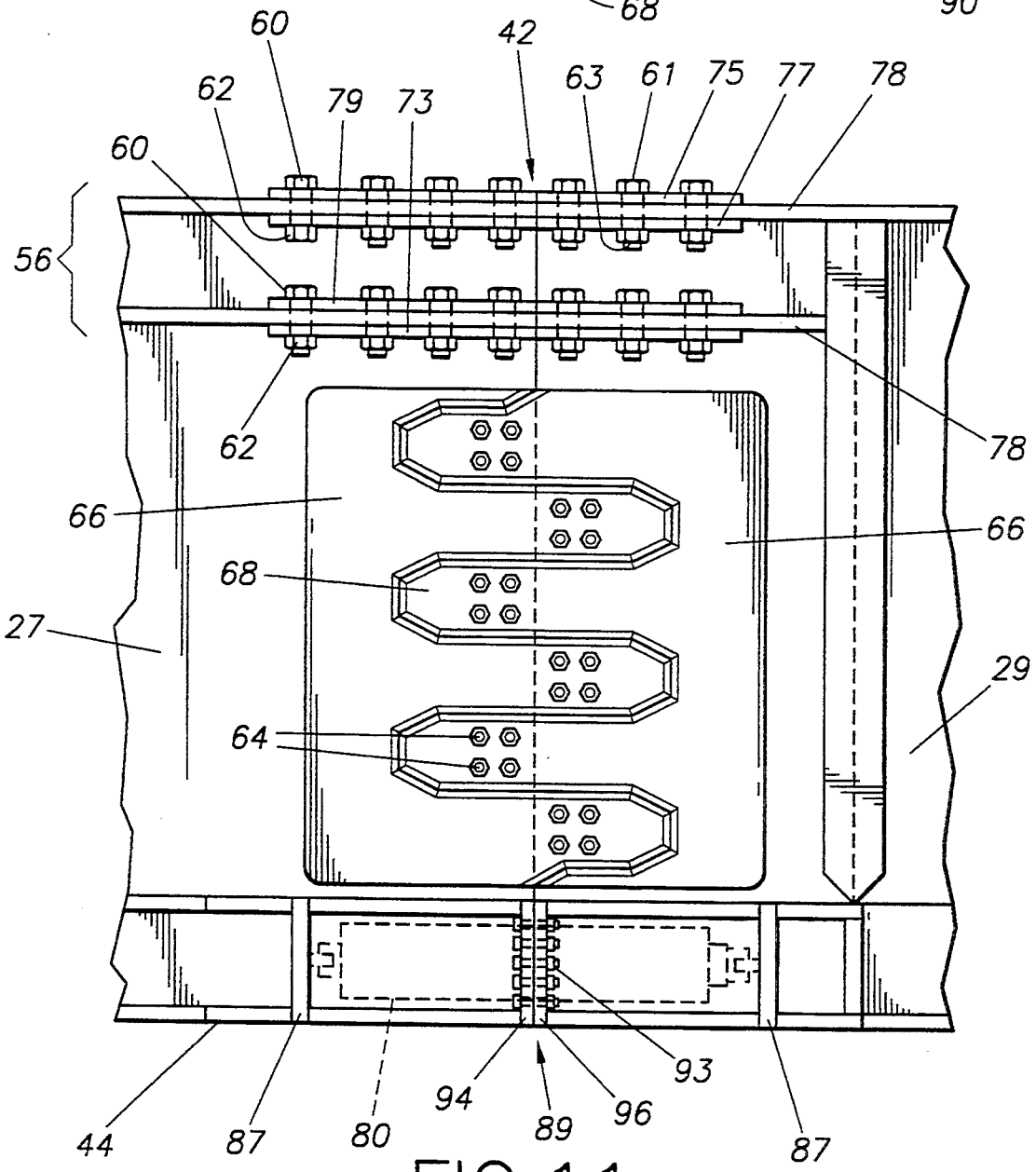
FIG. 11 illustrates the splice 42 in its closed and interlocked position.

In the process of interlocking the splice 42, one or more hydraulic jacks 80 are connected to the hydraulic jack support struts 87 as seen in FIG. 11, and the proximal inferior plate 94 and distal inferior plate 96 of FIG. 10B are pulled together and bolted with plate bolts 93. The fingers 68 as seen in FIG. 10B are interlocked together. The top plate pivotal array 74 and bottom plate pivotal array 76 may be connected to the two middle beam plates 78 to form two sandwiches by rotating one or more beam plates. The beam plates are then bolted together through the existing apertures.

Figure 10C:
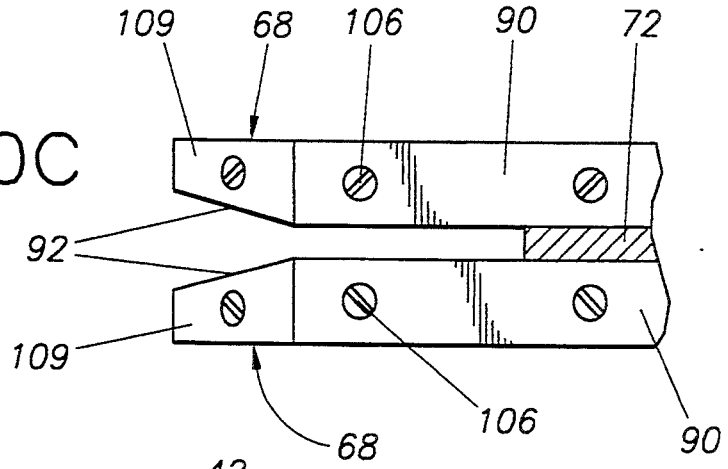
FIG. 10C illustrates a detailed partial sectional view of a finger 68 of the splice 42 of FIGS. 10A and 10B.

As seen in FIG. 10C, fingers 68 are joined together and cam against recessed cam surfaces 92. FIG. 10C shows a detailed sectional view of a finger 68 that forms part of the splice 42. The cantilever beam splice plate 90 from which the fingers 68 extend is shown on each side of the web plate 72.

FIG. 11 shows the splice after the fingers have been interlocked and the sandwiches are joined by a plurality of sandwich bolts 61 and sandwich nuts 63. Also, the inferior plate connection 89 is bolted with plate bolts 93 and nuts 95.

Figure 12:
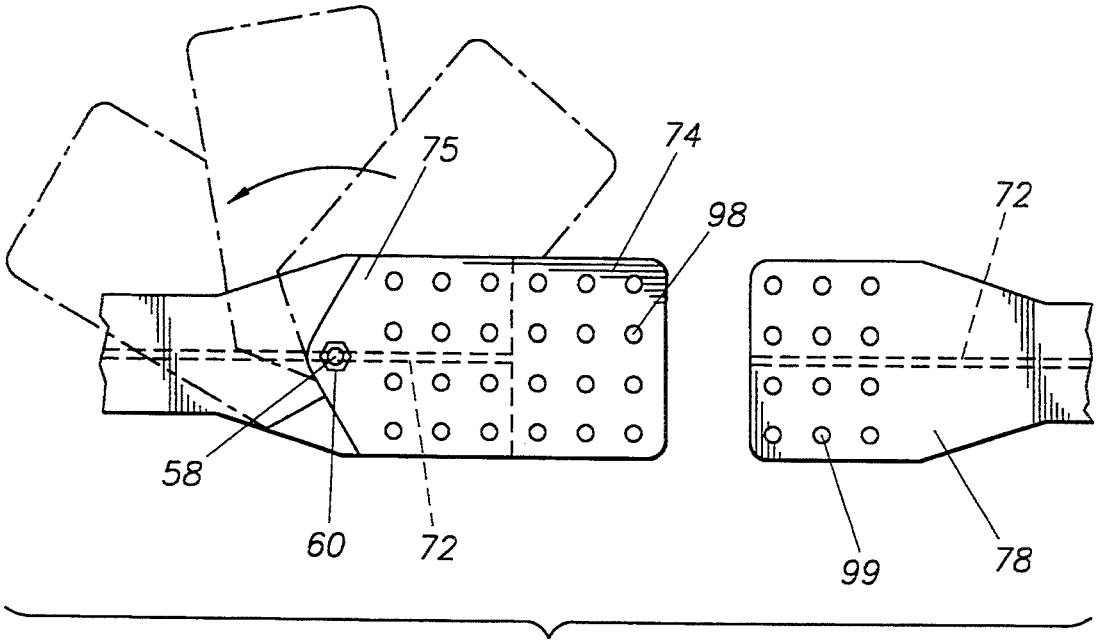
FIG. 12 illustrates a top view of the top beam plate 74 and middle beam plate 78 of the splice 42.

Turning now to FIG. 12, a top view of the top plate pivotal array 74 and one of the middle beam plates 78 may be seen. The top plate pivotal array 74 contains a plurality of top apertures 98 and the middle beam plate 78 contains a plurality of middle apertures 99. Furthermore, the full web top plate 75 rotates on an upper pin 60 that permits rotation about its axis 58 in a 360° radius.

FIG. 13 illustrates the bottom half web top plates 79, which, like the full web top plates 75, rotate on axes. The two half web back plates 73 cannot be seen in FIG 13. The axes of rotation are about the lower pins 62. Furthermore, the half web top plates 79 contain a plurality of bottom apertures 104 through which bolts will pass to form the two beam sandwiches 56 as seen in FIG. 11.

Figure 14:
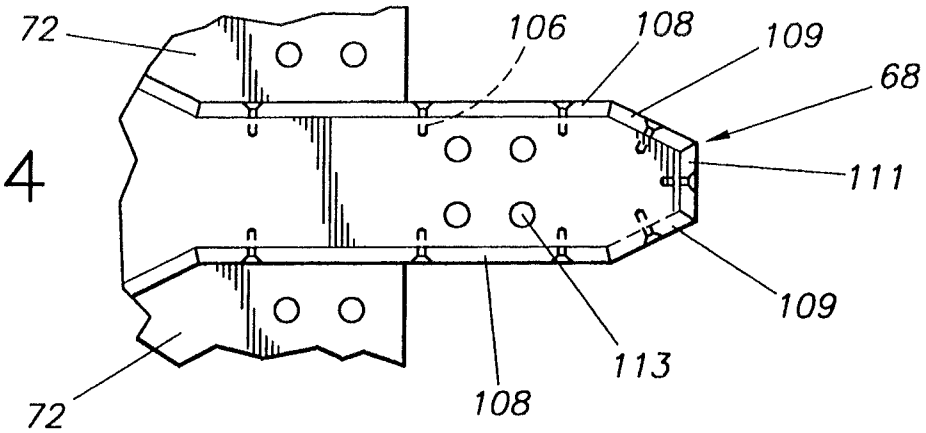
FIG. 14 illustrates a close-up view of a finger 68 of the splice 42.

FIG. 14 illustrates a side view of a finger 68 forming part of the splice 42 of the cantilever beam 4. The finger 68 is positioned adjacent a web plate 72 which is between opposing splice plates 90 as seen in FIG. 10C. The finger 68 includes a pair of lateral shims 108, a pair of diagonal shims 109, and an anterior shim 111. Each shim is connected to the finger 68 by shim screws 106. The shims serve to cam against the inner surface of the recessed finger pocket 70 (see FIG. 10B) during interlocking of the fingers 68. The recessed cam surfaces 92 (see FIG. 10C) are provided to cooperate to guide the base 27 and shuttle 29 together as they are urged into interlocking position.

A misalignment of the fingers 68 may be common, because it is very difficult to align the fingers 68 perfectly. For purposes of the present invention, it is believed that a misalignment of approximately 5° of the base 27 with the shuttle portion 29 is a tolerable misalignment during reconnection of the cantilever beam 4. During interlocking of the fingers 68, the shims are subjected to extreme concentrations of forces and may be damaged. To facilitate replacement of the wear surfaces of the fingers 68, the shims may be removed by means of the shim screws 106 and replaced.

Figure 15:
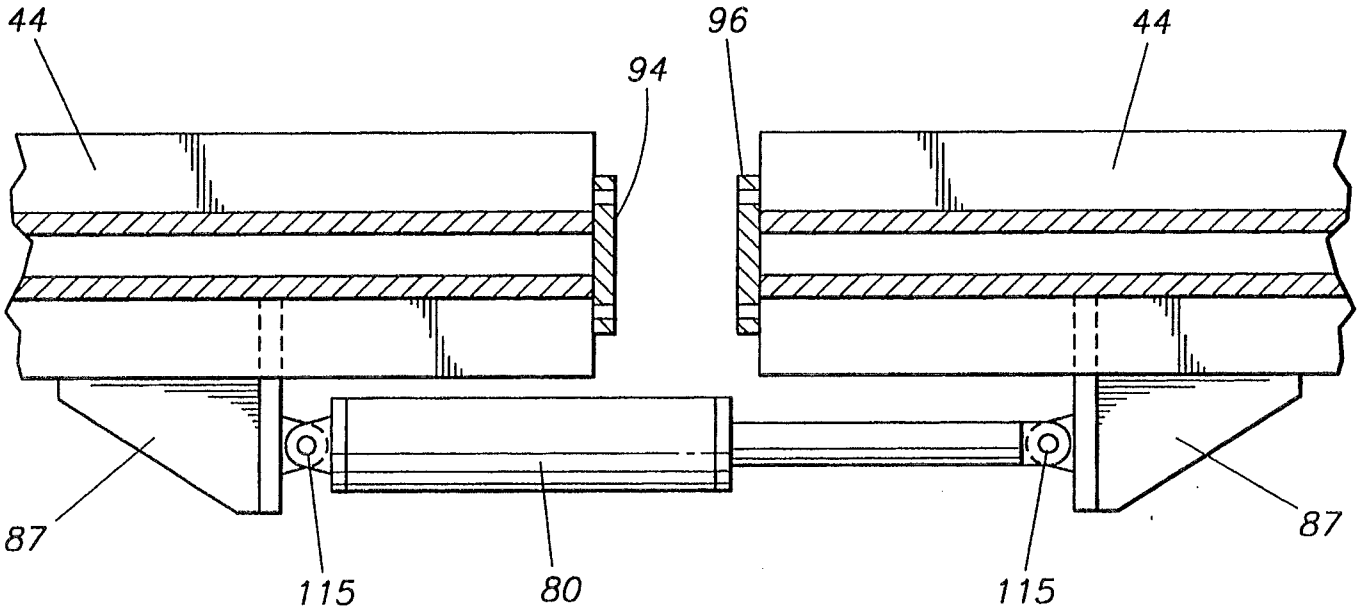
FIG. 15 illustrates a side view of the cantilever strut 44 and hydraulic jack 80.

FIG. 15 illustrates a cantilever strut 44, and it shows the position of the hydraulic jack 80 connected to the jack support struts 87. The hydraulic jack 80 is used to pull together the two portions of the cantilever strut 44 at the inferior plate connection 89 (see FIG. 11). The hydraulic jack 80 may be connected by means of the hydraulic jack bolt 115 during this procedure, and the jack 80 may be disconnected after interlocking of the fingers 68. This hydraulic jack 80 may be one used in the movement of the drilling package 10 upon the surface of the fixed platform 12.

Figure 16:
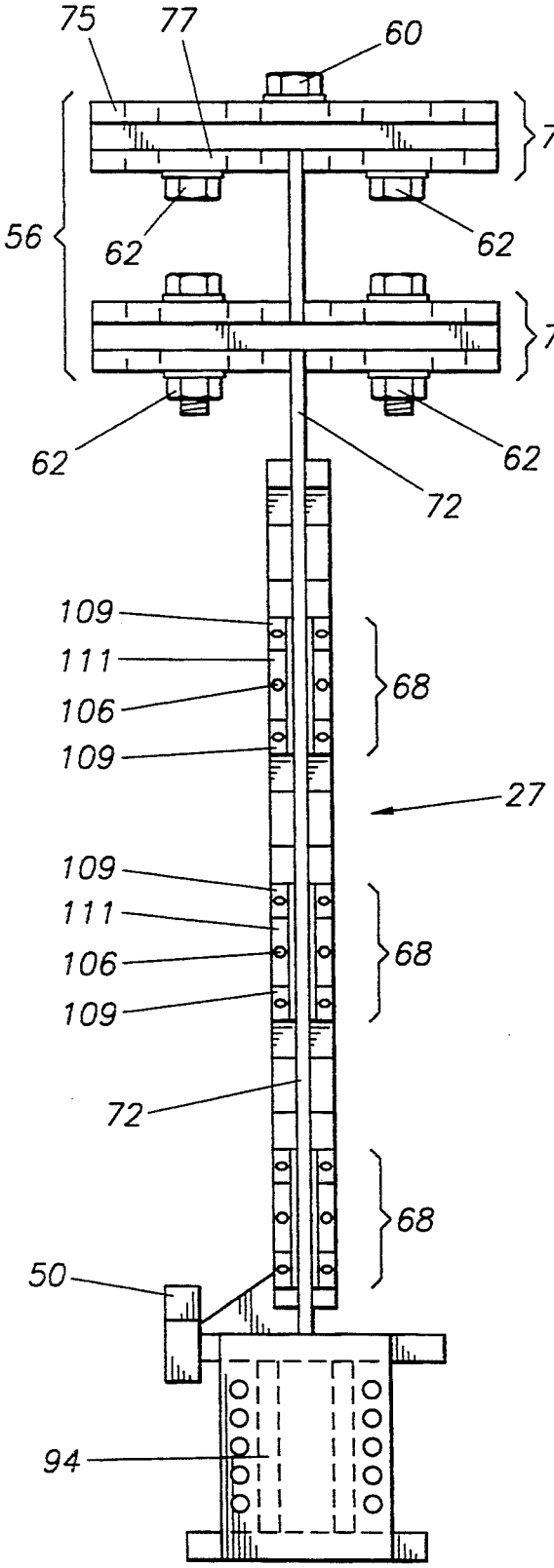
FIG. 16 illustrates a front view of the distal end of the proximal base portion 27 of the cantilever beam 4.

FIG. 16 illustrates an end view of the base 27 along section lines 16—16 in FIG. 10A. FIG. 16 shows an end view of the two beam sandwiches 56, and several fingers 68 may be seen.

Each finger 68 contains a pair of diagonal shims 109 and an anterior shim 111. The shims are held in place on the fingers 68 by shim screws 106. The skidder rack 50 cooperates with a rack-and-pinion gear (not shown).

Figure 17:
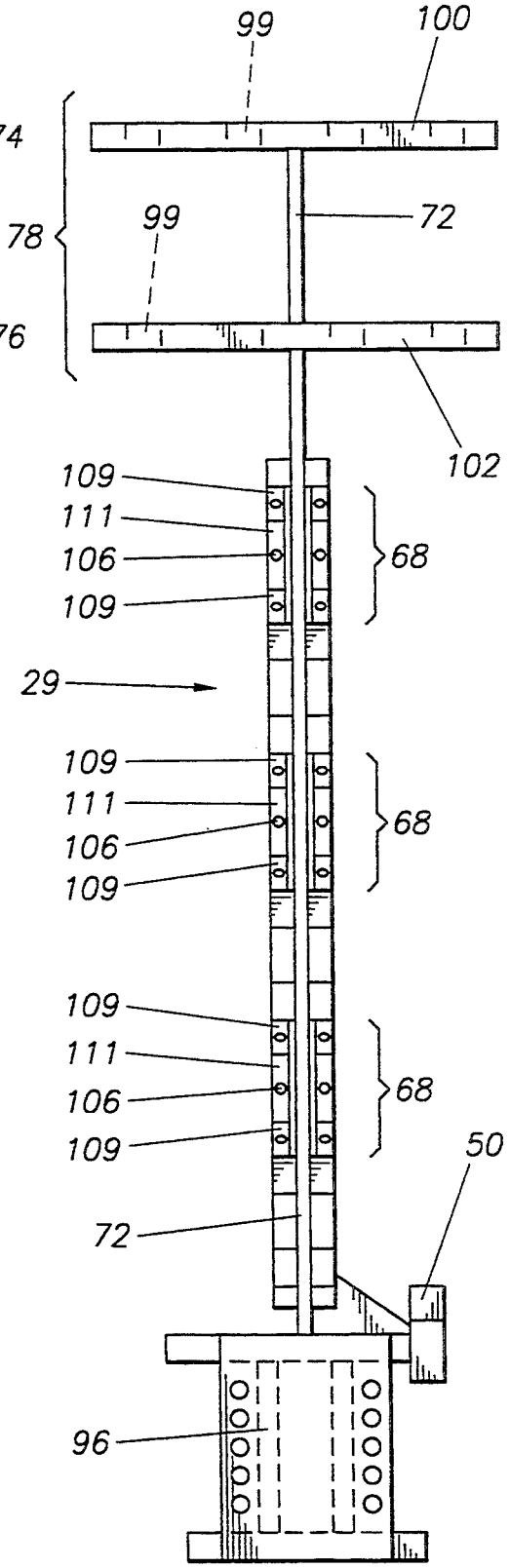
FIG. 17 illustrates the proximal end of the distal shuttle portion 29 of the cantilever beam 4.

FIG. 17 illustrates an end view of the shuttle 29 along section lines 17—17 in FIG. 10A. There can be seen the superior middle beam plate 100 and the inferior middle beam plate 102 that become a part of each beam sandwich 56. As also seen in FIG. 16, each finger 68 contains an anterior shim 111 and a pair of diagonal shims 109. Shim screws 106 secure the shims to the fingers 68. Diagonal shims 109 work to cam the base 27 and shuttle 29 together as they are urged in contact with each other. The camming facilitates the alignment of bolt holes of the shuttle 29 and base 27 into registration with each other as they are shown in FIG. 11.

FIG. 18 illustrates an alternative embodiment of the present invention in which to the functional package is a construction crane 37 to be extended to an outboard operating position. In that embodiment, the working range of a construction crane may be increased by extending the cantilever beam 4 from the deck 6 of the jack-up rig, whereby the cantilever beam supports the construction crane 37 in an extended position. The jack-up feature of the rig facilitates operating the crane at heights over the entire range of the length of the legs extending above the surface of the water. After extension beyond the perimeter of the deck of the jack-up rig, the construction crane 37 may be used to lift loads from that position, and the construction crane 37 may be later retracted onto the deck of the jack-up rig to position the crane for additional operations or to store the crane after construction is complete. As seen in FIG. 18, the construction crane may be used to build a bridge 120 or other structure located on shore. The placement of the crane on the jack-up deck for vertical positioning and on the cantilever beam for horizontal positioning provides advantageous flexibility. The configuration of the embodiment as shown in FIG. 18 increases the range of height and the radius of movement of the boom 117 of the construction crane 37 beyond that known in art.

Figure 19:
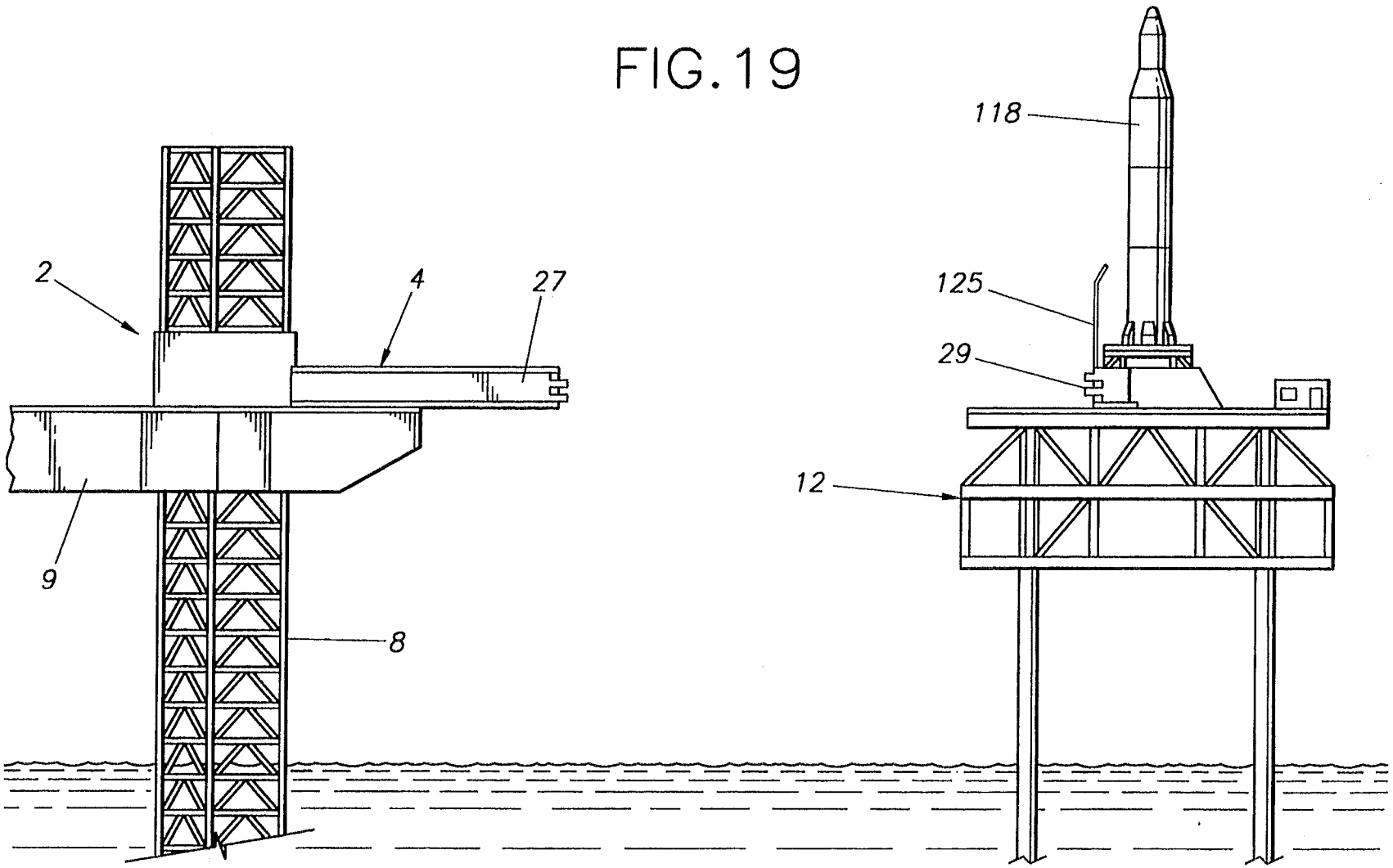
FIG. 19 illustrates an alternative embodiment of the present invention in which the functional package is a rocket launch module 118.

FIG. 19 illustrates an alternative embodiment of the present invention in which the functional package comprises a rocket launch module 118. A rocket containing, say, a communication satellite or other piece of equipment that is desired to be placed in orbit may be conveniently deployed by this invention. It is well known that a rocket launch generates a large amount of heat and noise, and such a launch may advantageously occur on a fixed platform over a large body of water. Launching over a body of water would be secured and environmentally benign compared to shore based launched. Furthermore, safety to persons on land may be increased by a rocket launch from a fixed platform in the ocean because the danger of falling debris, that occurs during the early stages of the launch, is minimized when the launch is executed at sea. The launch could occur on the fixed platform 12 or on the cantilever beam 4, as extended out over the jack-up rig.

Figure 20:
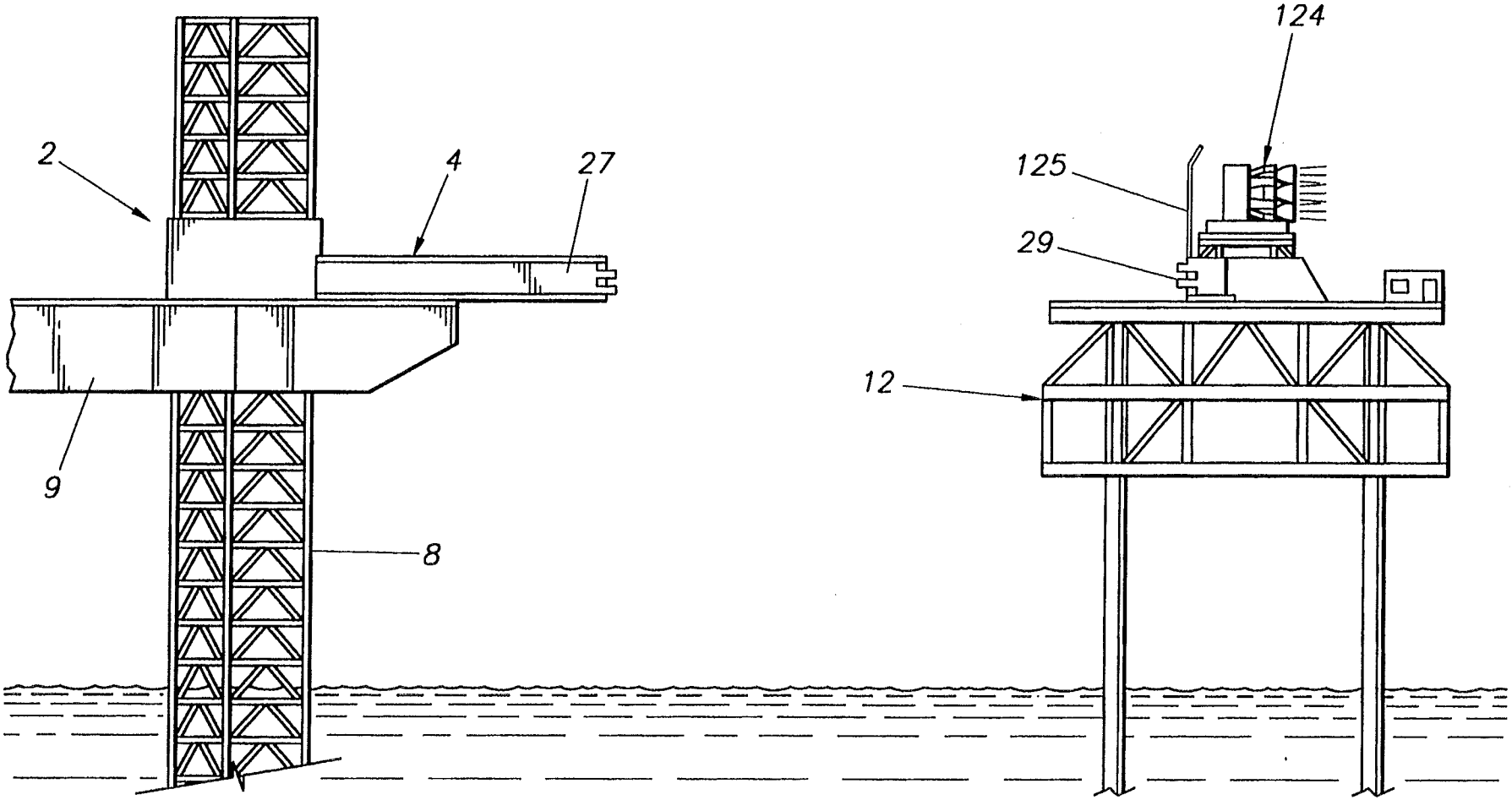
FIG. 20 illustrates an alternative embodiment of the present invention in which the functional package is an engine 124 to be tested upon the fixed platform 12.

FIG. 20 illustrates an alternative embodiment of the present invention in which the functional package is a rocket engine 124 to be tested upon the fixed platform 12. The testing of engines, and in particularly rocket engines, generates an enormous amount of noise, heat, and smoke that is bothersome and dangerous when conducted upon land. Therefore, it may be desirable to test engines upon a fixed platform 12. An alternative embodiment of the present invention comprises an apparatus for transferring an engine test module onto or from a jack-up rig 2 onto or from a fixed platform 12. A heat shield 125 may be mounted upon the distal shuttle portion of the cantilever beam to prevent excess heat from damaging the jack-up rig 2 or its occupants in the event that the engine is tested in close proximity to the jack-up rig 2. The testing could occur on a fixed platform 12 or on the cantilever beam 4, as extended out over the jack-up rig.

A surprisingly high degree of precision may be achieved in alignment of the massive components of the apparatus of this invention. The placement of a functional package on a fixed platform is believed to be achievable in significantly less time and with greater precision than with prior art arrangements.

I claim:

1. An apparatus for transferring a functional package from a jack-up rig to a fixed platform, comprising:

a cantilever beam adapted for separation into a distal shuttle portion and a proximal base portion, a functional package, said functional package being supportable by said distal shuttle portion, said cantilever beam being adapted for displacement of the functional package from an inboard position generally inside the outer edge of the jack-up rig to an outboard position over an edge of the jack-up rig and over a portion of a fixed platform, wherein the cantilever beam contains a splice for separation into said distal shuttle portion and said proximal base portion;

wherein the splice is comprised of fingers, the fingers having interlocking and opposing camming surfaces, the fingers projecting from both the distal shuttle portion and the proximal base portion of the cantilever beam;

said jack-up rig being adapted for supporting and positioning said cantilever beam;

the distal shuttle portion of said cantilever beam being separable from said proximal base portion and supportable by the fixed platform after separation.

2. An apparatus, as set forth in claim 1, wherein the functional package comprises a drilling package.

3. An apparatus, as set forth in claim 1, wherein the functional package comprises a construction crane.

4. An apparatus as set forth in claim 1, wherein the functional package comprises a rocket launch module.

5. An apparatus as set forth in claim 1, wherein the functional package comprises an engine to be tested.

6. An apparatus, as set forth in claim 2, wherein the cantilever beam contains a splice for separation into said distal shuttle portion and said proximal base portion.

7. An apparatus, as set forth in claim 6, wherein said splice is comprised of a plurality of fingers adapted to interlock.

8. An apparatus for transferring a functional package from a jack-up rig to a fixed platform, comprising:

a cantilever beam adapted for separation into a distal shuttle portion and a proximal base portion, a functional package, said functional package being supportable by said distal shuttle portion, said cantilever beam being adapted for displacement of the functional package from an inboard position generally inside the outer edge of the jack-up rig to an outboard position over an edge of the jack-up rig and over a portion of a fixed platform, wherein the cantilever beam contains a splice for separation into said distal shuttle portion and said proximal base portion;

wherein said splice is comprised of a plurality of fingers adapted to interlock, further wherein said slice is comprised of two beam sandwiches, each beam sandwich having a top plate pivotal array with top apertures, a bottom plate pivotal array with bottom apertures, and middle beam plates with middle apertures, wherein the top, bottom, and middle apertures are in registration to form a beam sandwich;

said jack-up rig being adapted for supporting and positioning said cantilever beam; and the distal portion of said cantilever beam being separable from said proximal base portion and supportable by the fixed platform after separation.

9. An apparatus as set forth in claim 8, wherein at least one of said top, middle and bottom beam plates pivot about an axis.

10. A cantilever beam for transferring a functional package from a jack-up rig to a fixed platform, said cantilever beam having a splice comprised of interlocking and opposing camming surfaces, said splice adapted for separation of said cantilever beam into a distal shuttle portion adapted to support the functional package on the fixed platform and a proximal base portion adapted to remain on the jack-up rig.

11. An apparatus for increasing the range of a construction crane, comprising:

a cantilever beam adapted for separation into a distal shuttle portion and a proximal base portion by disengaging a plurality of fingers, the construction crane being supportable by said distal shuttle portion, said cantilever beam being adapted for displacement of the construction crane from an inboard position generally inside the outer edge of a jack-up rig to an outboard position over an edge of the jack-up rig, said jack-up rig being adapted for supporting and positioning said cantilever beam.

12. A method of transferring a functional package from a deck of a jack-up rig to a fixed platform by separating a cantilever beam into a distal shuttle portion and a proximal base portion, comprising the steps of:

(a) transporting a jack-up rig containing a functional package to a location of a fixed platform;

(b) positioning the jack-up rig adjacent the fixed platform;

(c) raising the deck of the jack-up rig to position the cantilever beam above the height of the deck of the fixed platform, said cantilever beam comprising a proximal end and a distal end;

(d) extending the distal end of the cantilever beam from the deck of the jack-up rig;

(e) lowering the jack-up rig so that the distal shuttle portion of the cantilever beam rests upon the fixed platform;

(f) separating the distal shuttle portion of the cantilever beam;

(g) lowering the jack-up rig such that the upper surface of the proximal base portion of the separated cantilever beam is at about the same vertical height as the deck of the fixed platform; and (h) positioning an upper pipe rack upon the proximal base portion to facilitate the transfer of drilling pipe from the surface of the proximal base portion to the functional package.

13. The method of claim 12, wherein said functional package comprises a construction crane.

14. The method of claim 12, wherein said functional package comprises a drilling package.

15. The method of claim 12, wherein the functional package comprises a rocket launch module.

16. A method of transferring a functional package from a jack-up rig to a fixed platform by separating a cantilever beam into a distal shuttle portion and a proximal base portion, comprising the steps of:

(a) transporting a jack-up rig containing a functional package and a deck to a location of a fixed platform;

(b) positioning the jack-up rig adjacent the fixed platform;

(c) raising the deck of the jack-up rig to position the cantilever beam above the height of the deck of the fixed platform;

(d) extending the distal end of the cantilever beam from the deck of the jack-up rig;

(e) lowering the jack-up rig so that the distal shuttle portion of the cantilever beam rests upon the fixed platform;

(f) separating the distal shuttle portion of the cantilever beam by disengaging a plurality of fingers; and (g) repositioning the jack-up rig to another location.

17. The method of claim 16, additionally comprising the steps of:

(a) returning the jack-up rig to the location of the fixed platform;

(b) repositioning the jack-up rig adjacent the fixed platform;

(c) raising the deck of the jack-up rig to position the proximal base portion adjacent to the distal shuttle portion;

(d) reconnecting the proximal base portion with the distal shuttle portion to form the cantilever beam;

(e) retracting the distal end of the cantilever beam from the deck of the fixed platform;

(f) lowering the deck of the jack-up rig.

18. A method of transferring a functional package from a jack-up rig to a fixed platform by separating a cantilever beam into a distal shuttle portion and a proximal base portion, comprising the steps of:

(a) transporting, a jack-up rig containing a functional package to a location of a fixed platform;

(b) positioning the jack-up rig adjacent the fixed platform;

(c) raising the deck of the jack-up rig to position the cantilever beam above the height of the deck of the fixed platform;

(d) extending the distal end of the cantilever beam from the deck of the jack-up rig;

(e) lowering the jack-up rig so that the distal shuttle portion of the cantilever beam rests upon the fixed platform;

(f) separating the distal shuttle portion of the cantilever beam by disengaging a plurality of fingers and pivotally releasing the structural beam sandwiches by unbolting and then rotating beam plate sections at pivot points;

(g) repositioning the jack-up rig to another location;

(h) returning the jack-up rig to the location of the fixed platform;

(i) repositioning the jack-up rig adjacent the fixed platform;

(j) raising the deck of the jack-up rig to position the proximal base portion adjacent to the distal shuttle portion;

(k) reconnecting the proximal base portion with the distal shuttle portion to form the cantilever beam;

(l) retracting the distal end of the cantilever beam from the deck of the fixed platform; and (m) lowering the deck of the jack-up rig.

19. The method of claim 18, wherein said distal end of the cantilever beam contains a plurality of removable truss members, whereby extension and retraction of the distal end of the cantilever beam proceeds over one or more blow-out preventers and is accomplished by detaching and reattaching removable truss members, thereby preserving the structural integrity of the cantilever beam during passage of the functional package over one or more blow-out preventers.

20. The method of claim 19, further comprising the step of: reconnecting the proximal base portion to the distal shuttle portion using hydraulic jacks.

* * * * *

UNITED STATES PATENT AND TRADEMARK OFFICE

CERTIFICATE OF CORRECTION

PATENT NO. : 5,419,657
DATED : May 30, 1995
INVENTOR(S) : James B. Davis

It is certified that error appears in the above-indentified patent and that said Letters Patent is hereby corrected as shown below:

Column 1, line 12, delete "modular structure".

Column 1, line 67, change "amid" to --and--.

Signed and Sealed this

Twenty-second Day of August, 1995

*Attest:*

*Attesting Officer*

BRUCE LEHMAN

*Commissioner of Patents and Trademarks*